US007323283B2

(12) United States Patent
Yoshimoto et al.

(10) Patent No.: US 7,323,283 B2
(45) Date of Patent: Jan. 29, 2008

(54) METHOD OF PRODUCING AN ELECTROSTATIC CHARGE IMAGE DEVELOPING TONER

(75) Inventors: Nobuyuki Yoshimoto, Tokyo (JP); Hirokazu Kambara, Tokyo (JP); Tomomi Yamazaki, Tokyo (JP)

(73) Assignee: Toyo Ink Mfg. Co., Ltd., Tokyo (JP)

( * ) Notice: Subject to any disclaimer, the term of this patent is extended or adjusted under 35 U.S.C. 154(b) by 493 days.

(21) Appl. No.: 11/068,832

(22) Filed: Mar. 2, 2005

(65) Prior Publication Data

US 2005/0266333 A1 Dec. 1, 2005

(30) Foreign Application Priority Data

Mar. 3, 2004 (JP) ..... 2004-058499

(51) Int. Cl.
*G03G 9/08* (2006.01)

(52) U.S. Cl. ..... 430/137.18; 430/137.1

(58) Field of Classification Search ..... 430/137.18, 430/137.1

See application file for complete search history.

(56) References Cited

U.S. PATENT DOCUMENTS

2003/0054278 A1* 3/2003 Naka et al. ..... 430/110.3

FOREIGN PATENT DOCUMENTS

| | | | |
|---|---|---|---|
| JP | 48-25669 | B | 7/1973 |
| JP | 55-42752 | B | 11/1980 |
| JP | 56-164350 | A | 12/1981 |
| JP | 57-29704 | B | 6/1982 |
| JP | 57-119364 | A | 7/1982 |
| JP | 61-145255 | A | 6/1987 |
| JP | 62-145255 | A | 6/1987 |
| JP | 63-112626 | A | 5/1988 |
| JP | 63-112627 | A | 5/1988 |

(Continued)

*Primary Examiner*—Hoa Van Le
(74) *Attorney, Agent, or Firm*—McDermott Will & Emery LLP

(57) ABSTRACT

A pulverized starting material is supplied quantitatively from a quantitative feeder 1 to a first mechanical pulverizer 2 where the material is pulverized moderately, the resulting moderately pulverized material is supplied quantitatively from a quantitative feeder 3 to a second mechanical pulverizer 4 where the material is finely pulverized, and the resulting finely pulverized material is introduced into a coarse-powder classifier 5 to classify coarse powder not smaller than a predetermined particle diameter. The finely pulverized material from which the coarse powder was removed by classification is further classified fine powder not larger than a predetermined size by a fine-powder classifier 7 to produce a classified product, while the separated classified coarse powder is introduced into a returning-powder feeder 6. The classified coarse powder introduced into the returning-powder feeder 6 is again supplied quantitatively to the second mechanical pulverizer 4, upon which when it is detected that the weight of the coarse powder stored in the returning-powder feeder 6 is deviated from a predetermined range, the amount of the returning powder supplied to the second mechanical pulverizer 4 is changed and regulated such that the powder is supplied in the above changed amount. The pulverization conditions in the first and second mechanical pulverizers are established such that the volume-average particle diameter D1 (μm) of the moderately pulverized material obtained by the first mechanical pulverizer 2 and the volume-average particle diameter D2 (μm) of the finely pulverized material obtained by the second mechanical pulverizer satisfy: 3 μm≦D1−D2 ≦6 μm.

12 Claims, 4 Drawing Sheets

FOREIGN PATENT DOCUMENTS

| | | | |
|---|---|---|---|
| JP | 03-209266 | A | 9/1991 |
| JP | 05-313414 | A | 11/1993 |
| JP | 07-62766 | B | 7/1995 |
| JP | 7-244399 | A | 9/1995 |
| JP | 9-80808 | A | 3/1997 |
| JP | 11-255705 | A | 9/1999 |

* cited by examiner

METHOD OF PRODUCING AN ELECTROSTATIC CHARGE IMAGE DEVELOPING TONER

BACKGROUND OF THE INVENTION

1. Field of the Invention

The present invention relates to a method of producing an electrostatic charge image developing toner and an apparatus for producing an electrostatic charge image developing toner, for use in development of electrostatic charge images in an electrophotographic copier, a laser beam printer, an electrostatic recording device, an electrostatic printing device etc. where images are formed by an electrophotographic method, an electrostatic recording method etc.

2. Description of the Related Art

In copiers for copying transcripts, printers for printing information outputted by computers including personal computers, and printers in facsimiles, an electrophotographic method or an electrostatic recording method has been widely used as a method of obtaining copied or recorded images. Typical examples of copiers and printers using the electrophotographic method or electrostatic recording method include electrophotographic copiers, laser beam printers, printers using liquid crystal arrays, and electrostatic printers. In the electrophotographic method or electrostatic recording method, an electrostatic latent image (electrostatically charged image) is formed by various means on an electrostatic image carrier such as an electrophotographic photoreceptor or an electrostatic recording medium, then the electrostatic latent image is developed by a developer, and the resulting toner image is transferred if necessary onto a transfer body such as paper, and fixed by heating, pressurization, or pressurization under heating or with an evaporated solvent to give a final toner image, while the residual toner onto the electrostatic image carrier, which is not transferred, is removed by cleaning means. These steps are repeatedly conducted to give a plurality of copies or prints.

Known methods of developing the electrostatic latent image include a wet developing method using a liquid developer having a fine toner dispersed in an electrically insulating liquid; and a dry developing method where a powdery toner having a colorant and if necessary a magnetic material etc. which are dispersed in a binder resin is used together with carrier particles, or a magnetic toner having a magnetic material dispersed in a binder resin is used without using carrier particles. Among these methods, the above-mentioned dry developing method using the powdery or magnetic toner is used mainly in recent years.

The magnetic or non-magnetic fine toner in a developer used in the dry developing method is produced in various manners. Examples of method of producing the toner powder in the developer include a pulverizing method, a spray drying method, a suspension polymerization method, and a microcapsulation method. The pulverizing method involves steps of preliminarily mixing a binder resin, a colorant, a charge control agent and other customary additives which are materials constituting the toner powder in an electrostatic developer, melt-kneading the mixture, cooling and pulverizing it into coarse powder and then finely pulverizing it and classifying the finely pulverized powder to give toner powder. The spray drying method involves steps of dispersing the constituent components in a binder resin solution and spray-drying the solution to give toner base particles. The suspension polymerization method involves steps of suspending and dispersing a monomer capable of forming a binder resin, a colorant and other additives in an aqueous solvent and polymerizing the mixture to give toner base particles. The microcapsulation method involves a step of incorporating predetermined materials into a core material and/or a shell material to give toner base particles. Among these methods, the production methods other than the pulverizing method are not practically widely used because the shape of the resulting toner base particles is nearly perfect sphere so that after transferring the toner onto a recording medium, there is a technical difficulty in cleaning the toner remaining on the image carrier and there is also an economical problem. Accordingly, the pulverizing method is generally used at present to obtain the electrostatic charge image developing toner.

In the method of producing the toner by the pulverizing method, materials constituting the toner are preliminarily mixed in a blender, melt-kneaded in a kneader to disperse uniformly the toner constituent materials in a binder resin, then cooled, pulverized and classified to give toner particles having desired particle-size distribution. The average particle diameter of the toner used in a developer for electrostatic charge images is usually 8 to 20 μm, but as the images with high quality are required in recent years, the toner having an average particle diameter of 6 to 12 μm is mainly used now. Then if necessary, a external additive is added to and mixed with the toner particles thus obtained, followed by removing aggregates by a sieve or the like, whereby the electrostatic charge image developing toner is obtained.

As the method of producing the toner by the pulverizing method, various methods have been proposed. As an example of typical methods using the pulverizing method, there is illustrated a closed circuit system wherein a pulverized starting material is pulverized by a pulverizer for pulverizing finely the starting materials, then the pulverized material is classified, and the whole of the classified coarse powder together with a pulverized starting material is fed again into the pulverizer and pulverized. In this closed circuit system, the whole of the classified coarse powder is fed again into the pulverizer. At this time, a change in the pulverization of the pulverizer appears as a change in the average particle diameter $D_{50}$ of the pulverized material discharged from the pulverizer. Depending on this change in pulverization, the amount of the coarse powder fed again into the pulverizer is increased or decreased widely, thus causing a problem that excessive load to the pulverizer is given, or the particle-size distribution of toner powder obtained by classification changes. The change of the particle-size distribution of toner powder leads to unstable production of toners having constant particle-size distribution. To cope with such a problem, there are proposed a method wherein upon feeding the classified coarse powder to the pulverizer as returning powder, the returning powder is quantitatively supplied in amount of 5 times or less in the ratio than the amount of a pulverized starting material to be fed (see JP-A 3-209266).

This method is illustrated by reference to FIG. 4. Starting powder having a $D_{50}$ of 300 to 500 μm is used, and this starting powder is fed in a predetermined supplying amount f1 from a pulverized stating material quantitative feeder 41 to a pulverizer 42 for pulverizing the starting materials finely, where the starting material is pulverized. The pulverized material is sent to a coarse-powder classifier 43 consisting of a rotating air classifier where coarse powder is classified and then returned to the pulverizer 42. Upon returning classified coarse powder to the pulverizer 42, the classified coarse powder is stored once in a returning-powder quantitative feeder 47 where the amount f2 of the returning powder fed from the returning-powder quantitative feeder 47 to the pulverizer 42 is regulated to be 5 times or less relative to the amount f1 of a pulverized starting material to be supplied. The returning-powder quantitative feeder 47 is provided with a weight detector. The particle diameter $D_{50}$ of the classified and captured pulverized product is measured, while by the weight detecting function of the weight detector, the difference (Δw1) between the amount f3 of the returning powder fed from the rotating air classifier 43 to the returning-powder quantitative feeder 47 and the amount f2 of the powder fed from the returning-powder quantitative feeder 47 to the pulverizer is measured. When there is a change in $D_{50}$ and Δw1, the optimum values of revolution number r1 of a rotating blade in the coarse-powder classifier and the amount f1 of the pulverized starting material to be supplied are calculated based on a predetermined formula, to correct the revolution number r1 of a rotating blade in the coarse-powder classifier and the amount f1 of the pulverized starting material to be supplied. This correction may be conducted by automatically measuring the particle diameter of the classified and captured pulverized product and the weight of the returning-powder quantitative feeder, and automatically regulating the revolving speed of the air classifier and the amount f1 of the supplied pulverized starting material by a computer. The pulverized material from which coarse powder was removed is sent to a cyclone 44 where the pulverized material from which coarse powder was removed is captured to give a pulverized product. Exhaust gas from the cyclone 44 is sent to a bug filter 45 where fine powder is captured, and the gas is discharged from a blower 46.

By this method, the particle diameter of the classified and captured pulverized product comes to be within a certain range, and the amount f2 of the powder fed from the returning-powder quantitative feeder 47 to the pulverizer 42 is quantitatively regulated. Specifically, the amount f2 of the returning powder quantitatively fed is about 3 times as high as the amount f1 of the pulverized starting material fed. That is, in this method, the classified coarse powder is circulated several times thorough the closed circuit, and there is a problem that the amount of the product obtained is small as compared with the amount of the material pulverized by the pulverizer. Accordingly, the efficiency of energy for pulverization is not sufficient. For obtaining a pulverized product having a stable particle diameter, it is necessary to always regulate the revolution number r1 of a rotating blade in the coarse-powder classifier and the amount f1 of the pulverized starting material to be supplied, thus making manual management troublesome. On the other hand, when automatic regulation is conducted, a detector or the like should be newly arranged, and it brings an economical problem. In the conventionally proposed method, visual examination is basically always necessary, and even by regular visual examination, there is a problem that stable production of toner base powder having desired particle-size distribution and production of the toner base powder with high energy efficiency are difficult, therefore production costs are hardly sufficiently reduced.

Other known methods include a method wherein two pulverizers each utilizing, for example, a jet air stream are used, and a pulverized starting material obtained by classification of starting powder is pulverized by the first pulverizer and then the pulverized material is classified to remove coarse powder, and if necessary the classified coarse powder is mixed with the starting powder and then classified, and the classified coarse powder is pulverized by the second pulverizer, whereby toner powder with a narrow particle-size distribution is produced efficiently without fusion of the toner during production (see JP-A 63-112626, JP-A 63-112627 and JP-A 5-313414); a method of producing toner powder having a small particle diameter by using a combination of a pulverizer utilizing a jet air stream (Jet Mill or I-Mill) and a mechanical pulverizer (see JP-A 5-313414 and JP-A 9-80808); and a method wherein a toner powder pulverized with a first pulverizer is rendered spherical by surface pulverization with an collision pulverizer (see JP-A7-244399). However, any of these methods cannot produce pulverized toner powder having a predetermined particle-size distribution efficiently and stably without requiring regular visual examination, thus further improvements being expected.

SUMMARY OF THE INVENTION

An object of the present invention is to provide a method of producing an electrostatic charge image developing toner to solve the problems in the related art described above.

That is, an object of the present invention is to provide a method of producing an electrostatic charge image developing toner efficiently.

Another object of the present invention is to provide a method of producing an electrostatic charge image developing toner efficiently and simultaneously producing toner powder having a predetermined particle-size distribution stably for a long time without fusion to a toner production apparatus and without regulation of a line.

A further object of the present invention is to provide a method of producing an electrostatic charge image developing toner excellent in fluidity and superior in development properties for a long time.

The present invention relates to the following methods of producing an electrostatic charge image developing toner:

(1) A method of producing an electrostatic charge image developing toner, which comprises at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D1 (μm) of the moderately pulverized material obtained by the first mechanical pulverizer and the volume-average particle diameter D2 (μm) of the finely pulverized material obtained by the second mechanical pulverizer satisfy the equation: $3\ \mu m \leqq D1 - D2 \leqq 6\ \mu m$.

(2) A method of producing an electrostatic charge image developing toner, which comprises at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D2 (μm) of the finely pulverized material obtained by the second mechanical pulverizer and the volume-average particle diameter D3 (μm) of the coarse powder classified in the coarse-powder classifier satisfy the equation: $D3-D2 \leqq 6$ μm.

(3) A method of producing an electrostatic charge image developing toner, which contains at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D1 (μm) of the moderately pulverized material obtained by the first mechanical pulverizer, the volume-average particle diameter D2 (μm) of the finely pulverized material obtained by the second mechanical pulverizer and the volume-average particle diameter D3 (μm) of the coarse powder classified in the coarse-powder classifier satisfy the equations: $3\ \mu m \leqq D1-D2 \leqq 6$ μm, and $D3-D2 \leqq 6$ μm.

(4) The method of producing an electrostatic charge image developing toner according to any one of the above-mentioned items (1) to (3), wherein the changed amount of the returning powder supplied from the returning-powder feeder to the second mechanical pulverizer is within ±20% relative to the amount of the moderately pulverized material supplied to the second mechanical pulverizer.

(5) The method of producing an electrostatic charge image developing toner according to any one of the above-mentioned items (1) to (4), wherein the mean circularity of the moderately pulverized material is 0.88 to 0.90, the mean circularity of the classified product is 0.90 to 0.93, and the standard deviation of the circularity of the classified product is 0.07 or less.

(6) The method of producing an electrostatic charge image developing toner according to any one of the above-mentioned items (1) to (5), wherein the moderately pulverized material obtained by pulverization in the first mechanical pulverizer is sent to a moderate pulverized material quantitative feeder and quantitatively supplied from the moderately pulverized material quantitative feeder to the second mechanical pulverizer, in the same amount as that of the pulverized starting material to be supplied.

(7) The method of producing an electrostatic charge image developing toner according to any one of the above-mentioned items (1) to (5), wherein the whole of the moderately pulverized material obtained by the first mechanical pulverizer is supplied to the second mechanical pulverizer.

(8) The method of producing an electrostatic charge image developing toner according to any one of the above-mentioned items (1) to (7), wherein the pulverized starting material and/or the moderately pulverized material is supplied without classification to the first or second mechanical pulverizer.

(9) The method of producing an electrostatic charge image developing toner according to any one of the above-mentioned items (1) to (8), wherein the volume-average particle diameter of the classified product is 5 to 12 μm.

(10) The method of producing an electrostatic charge image developing toner according to any one of the above-mentioned items (1) to (9), wherein the amount of the classified coarse powder obtained by the coarse-powder classification is less than 50% of the amount of the fine pulverized material obtained by the second pulverizer.

(11) The method of producing an electrostatic charge image developing toner according to any one of the above-mentioned items (1) to (10), wherein the coarse-powder classifier is an air stream classifier.

(12) The method of producing an electrostatic charge image developing toner according to any one of the above-mentioned items (1) to (9), wherein the classified product is mixed with external additives.

DETAILED DESCRIPTION OF THE INVENTION

Hereinafter, a method of producing an electrostatic charge image developing toner according to the present invention will be described in more detail by reference to the drawings.

Figure 1:
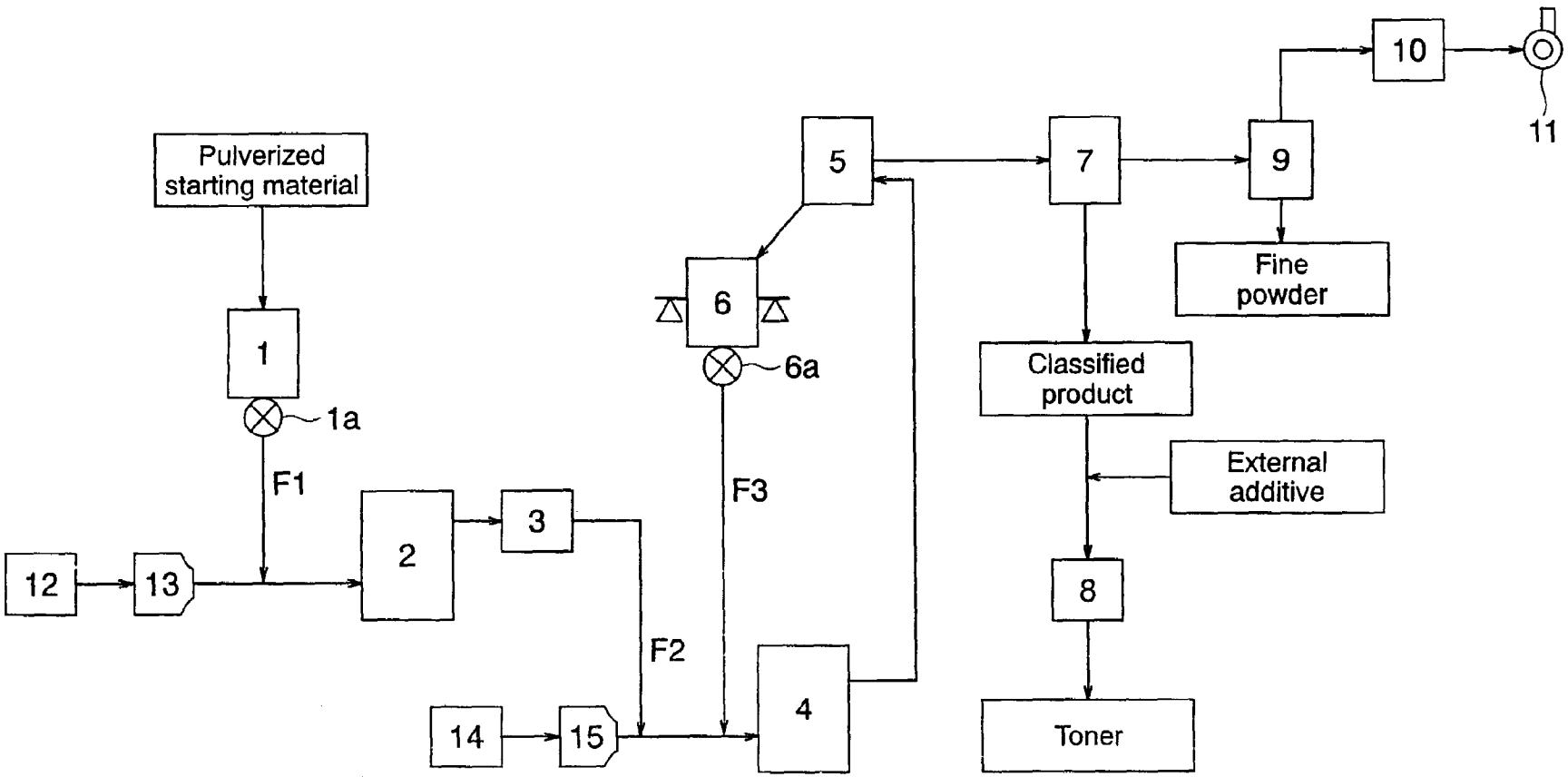
FIG. 1 is an illustrative diagram showing a method of producing an electrostatic charge image developing toner according to the present invention.

In FIG. 1, reference numeral 1 is a pulverized starting material quantitative feeder, reference numeral 2 is a first mechanical pulverizer (referred to hereinafter as first pulverizer), reference numeral 3 is a moderately pulverized material quantitative feeder, reference numeral 4 is a second mechanical pulverizer (referred to hereinafter as second pulverizer), reference numeral 5 is a coarse-powder classifier, reference numeral 6 is a returning-powder feeder, reference numeral 7 is a fine-powder classifier, reference numeral 8 is a mixer, reference numeral 9 is a cyclone, reference numeral 10 is a bug filter, reference numeral 11 is a blower, reference numeral 12 is a fan, and reference numeral 13 is a cooling unit.

In the apparatus for producing an electrostatic charge image developing toner in FIG. 1, a pulverized starting material containing at least a binder resin and a colorant, accommodated in a pulverized starting material quantitative feeder 1, is fed quantitatively to the first pulverizer 2 via a feeder 1*a* of the pulverized starting material quantitative feeder 1 in a predetermined supply amount (F1). As the pulverized starting material, there are used so-called flakes that are produced by melt-kneading a mixture containing at least a binder resin and a colorant, cooling and solidifying the kneaded mixture, and pulverizing the solidified material. In the method of producing an electrostatic charge image developing toner according to the present invention, the whole of the pulverized starting material fed to the first pulverizer 2 is supplied to the first pulverizer without subjection to a classification step for removing fine particle in the pulverized starting material, and moderately pulverized therein. On the other hand, when a method is used wherein the pulverized starting material is classified to remove fine powder from the pulverized starting material, then the pulverized starting material from which fine powder was removed is moderately pulverized in the first pulverizer, and the resulting moderately pulverized material is mixed with the fine powder classified previously from the pulverized starting material, and pulverized in the second pulverizer, the shape of particles is not stable due to mixing of angular particles. Accordingly the resulting developer is poorer in fluidity than that of a developer obtained by pulverizing the whole of the starting material in the first pulverizer and the density of the developed image by the resulting developer is lower than that of a developer obtained by pulverizing the whole of the material in the first pulverizer.

When the pulverized starting material is supplied to the first pulverizer, it is preferred that a delivery gas used in delivering and supplying the pulverized starting material to the first pulverizer is cooled with the cooling unit 13 in order to prevent fusion of the pulverized toner powder upon pulverizing the pulverized starting material in the first pulverizer 2. In addition, the pulverized starting material is preferably the one having a particle diameter of 3 mm or less so as not to get the moderately pulverized material having a desired particle diameter without excessive load on the first pulverizer 2.

The pulverized starting material introduced into the first pulverizer 2 is mechanically pulverized to form a moderately pulverized material T1. This moderate pulverization is carried out by a mechanical pulverizer, thus giving a pulverized material having higher circularity than one pulverized by a collision pulverizer such as a jet mill and an I-Mill. In the collision pulverizer such as a jet mill and an I-Mill, superfine powder which is extremely finer than desired is generated upon collision of the pulverized starting material with a collision plate, thus reducing the yield and varying the shape of the pulverized material disadvantageously. The volume-average particle diameter of the moderately pulverized material obtained by the moderate pulverization of the invention shall be greater by 3 to 6 μm than the volume-average particle diameter of the finely pulverized material obtained by the second pulverizer. The following is the reason. That is, when the starting material is pulverized all at once to produce a pulverized material having an average-volume particle diameter near to the volume-average particle diameter of the desired classified product, a load applied to the pulverizer is increased, and the particle-size distribution of the resulting pulverized material becomes broad. When this pulverized material is pulverized in a closed circuit, the amount of the classified coarse powder is increased, and the increased amount of the pulverized material circulated in the closed circuit causes deterioration of the efficiency of production. Upon the pulverized material being passed several times through the pulverizer, excessive pulverization energy is given to the pulverized material, thus changing the shape of the toner to deteriorate the qualities of the resulting classified product, and deteriorate the properties of the electrostatic charge image developing toner. When the difference between the volume-average particle diameter of the moderately pulverized material and the volume-average particle diameter of the finely pulverized material obtained by the second pulverizer is less than 3 μm, the load to the first pulverizer increases to reduce the efficiency of production as described above, and the particle-size distribution of the resulting pulverized material becomes broad to cause a problem in production. When the volume-average particle diameter of the moderately pulverized material is larger by 6 μm or more than the volume-average particle diameter of the finely pulverized material obtained by the second pulverizer, there are caused following problems. That is, the particle-size distribution of the finely pulverized material upon being finely pulverized by the second pulverizer becomes broad, the amount of the classified coarse powder is increased, and the amount of the classified coarse powder is varied. This makes it necessary to increase the frequency of a change of the amount of the returning powder supplied from the returning powder feeder or to change significantly the amount of the material to be supplied. There are also problems that the circularity of the finely pulverized material is decreased, the value of the standard deviation of the circularity of the classified product is increased, and a toner excellent in fluidity is hardly obtained.

The volume-average particle diameter of the moderately pulverized material T1 is varied depending on the volume-average particle diameter of the classified product, but shall be usually about 8 to 18 μm. In the present invention, the mechanical pulverizer, which is also called mechanical eddy air current pulverizer, refers to a pulverizer comprising a rotor rotating at high speed and a liner having a large number of grooves, wherein pulverization occurs in a gap between the rotating rotor and the liner and by the continual heavy collisions and contacts between particles caused by movement of an air laminar flow or eddy arising on grooves in the rotor and liner. Examples of such pulverizers include Kryptron series (Krypton and Krypton Eddy) manufactured by Kawasaki Heavy Industries, Ltd., Turbo Mill manufactured by Turbo Kogyo Co., Ltd., and Blade Mill manufactured by Nisshin Engineering Co., Ltd. In the present invention, the volume-average particle diameter is measured by Multisizer manufactured by Coulter Counter Inc.

When producing the moderately pulverized material T1 having a desired particle diameter, the first pulverizer 2 may be cooled externally if necessary. The cooling temperature may be suitably determined depending on the composition and pulverizability of the pulverized starting material and a particle diameter after pulverization, but is preferably lower, usually preferably 2° C. or less, for example −2 to 2° C. Because the pulverized starting material is mechanically pulverized by the first pulverizer, the shape of the moderately pulverized material obtained is highly circular. The mean circularity of the moderately pulverized material is varied depending on the pulverizability of the pulverized starting material, the output power of the first pulverizer and the amount of the pulverized starting material supplied to the first pulverizer. Accordingly, it is preferred that in response to the mean circularity required to the toner product, the pulverization conditions are suitably established and the mean circularity of the moderately pulverized material is established. The mean circularity of the moderately pulverized material is usually 0.88 to 0.90. In the present invention, the circularity of the particles including the toner particles is used for quantitatively expressing the shape of the pulverized product, and the circularity is a value measured by the following method. The mean circularity and the standard deviation of circularity are calculated by the following method. The numerical value of circularity in the present invention is obtained on the basis of the number of particles.

[Method of Measuring Circularity]

After measurement of particles with a Flow Particle Image analyzer FPIA-2100 manufactured by Sysmex Corporation, their circularity is defined as a value obtained by the following equation (1):

$$\text{Circularity } a = Lo/L \tag{1}$$

wherein Lo represents the circle circumference of a circle having the same area as that of a projected image of a particle, and L represents the perimeter of the projected particle image.

Specifically, the measurement method is carried out as follows. That is, 0.1 to 0.5 ml surfactant, preferably alkyl benzene sulfonate, is added as a dispersant to 100 to 150 ml water, from which solid impurities have been previously removed, in a container, and about 0.1 to 0.5 g measurement sample is added thereto. The resulting suspension having the sample dispersed therein is treated for about 1 to 3 minutes with an ultrasonic dispersing unit, and the resulting dispersion is adjusted to a density of 3,000 to 10,000 particles/μl, and then the shape and particle size of the toner powder are measured. The circularity is an indicator of inequalities of the toner powder wherein a circularity of 1 indicates a complete sphere of toner powder, and the value of the circularity is made small as the surface shape is made complex or deviated from sphere.

[Formula for Calculation of Mean Circularity]

The mean circularity $\overline{C}$ of toner particles having a circle equivalent diameter of 3 μm or more (based on the number of particles) determined by a Flow Particle Image Analyzer refers to a mean value of circularity frequency distribution of toner powder having a circle equivalent diameter of 3 μm or more, and is calculated by the following equation (2):

$$\text{Mean circularity } \overline{C} = \sum_{i-1}^{m} (fci \times ci) \Big/ \sum_{i-1}^{m} (fci) \tag{2}$$

wherein ci is circularity (center value) at division point i of particle distribution, and fci is frequency.

[Formula for Calculation of the Standard Deviation of Circularity]

The standard deviation (based on the number of particles) of circularity is a numerical value expressed as SD of circularity in a Flow Particle Image Analyzer FPIA-2100, and determined by dividing the sum of squares of the circularity of each particle and mean circularity by the number of particles in total and then calculating the square root of the quotient.

The whole of the moderately pulverized material T1 discharged from the first pulverizer 2 is transferred without classification to a moderately pulverized material quantitative feeder 3 and then supplied quantitatively from the moderately pulverized material quantitative feeder 3 to the second pulverizer 4. The amount F2 of the moderately pulverized material supplied from the moderately pulverized material quantitative feeder 3 to the second pulverizer 4 shall be the same amount as the amount F1 of the pulverized starting material supplied to the first pulverizer 2. Accordingly, the moderately pulverized material discharged from the first pulverizer 2 may, without passing via the moderately pulverized material quantitative feeder 3, be supplied directly to the second pulverizer 4. When the moderately pulverized material T1 is delivered from the first pulverizer 2 to the second pulverizer 4, air used in this delivery may be cooled with a cooling unit 15.

In the second pulverizer 4, the moderately pulverized material T1 is mechanically pulverized together with the classified coarse powder described later and converted from the moderately pulverized material into finely pulverized material T2 having an volume-average particle diameter smaller by 3 to 6 μm than that of the moderately pulverized material. The volume-average particle diameter of the finely pulverized material T2 varies depending on the particle diameter of the final product, but is usually 4 to 12 μm. When the moderately pulverized material and the classified coarse powder are pulverized in the second pulverizer, the second pulverizer 4 may be externally cooled in pulverization as same as the first pulverizer 2, if necessary. The cooling temperature is preferably 2° C. or less. The rotational speed of a rotor of the second pulverizer 4 is preferably lower than the rotational speed of a rotor of the first pulverizer 2 when the first pulverizer 2 and the second pulverizer 4 are pulverizers of the same kind. By pulverization with such a reduced rotational speed of the second pulverizer 4, a pulverized material having narrower particle-size distribution can be obtained with a smaller amount of fine powder. In the present invention, the rotational speeds of the rotors in the first and second pulverizers are varied depending on the particle diameter of the pulverized starting material, the volume-average particle diameters of the moderately pulverized material and finely pulverized material produced by the first and second pulverizers, and the type of the first and second pulverizers; for example, when Kryptron KTM-2 manufactured by Kawasaki Heavy Industries, Ltd. is used as the first and second pulverizers, the rotational speed of the rotor in the first pulverizer is usually about 5000 to 6200 rpm, while the rotational speed of the rotor in the second pulverizer is usually about 4000 to 6200 rpm. The rotational speed of the rotor in the first pulverizer is made higher because in the first pulverizer, a pulverized starting material having large particle diameter, for example an average particle diameter of about 1 mm (passing through a 3-mm mesh), should be pulverized all at once to a size of 8 to 12 μm, for example about 10 μm in the average particle diameter, while in the second pulverizer, the moderately pulverized material and the classified coarse powder having small average particle diameter are formed into a finely pulverized material having a volume-average particle diameter smaller by several μm. In the second pulverizer similar to the first pulverizer, mechanical pulverization is carried out, thus further improving the circularity of the toner powder having high circularity obtained by the first pulverizer. The mean circularity of the moderately pulverized material T1 obtained in the first pulverizer is for example 0.88 to 0.90 as described above, while the mean circularity of the finely pulverized material obtained in the second pulverizer is for example 0.90 to 0.93. The standard deviation of the circularity of the moderately pulverized material is 0.08 or less, while that of the finely pulverized material is also 0.08 or less. When the standard deviation of the circularity of the classified product is 0.07 or less, an electrostatic charge image developing toner, which has preferable fluidity and developing properties, can be obtained.

The fine pulverized material T2 discharged from the second pulverizer 4 is sent to the coarse-powder classifier 5, whereby coarse powder is classified and separated. The established particle diameter of the coarse powder to be separated may be made a suitable value depending on the average particle diameter of the toner product. Usually, the volume-average particle diameter of the toner product is 5 to 20 μm, preferably about 5 to 12 μm; for example, when a toner product having a volume-average particle diameter of 10 μm is to be obtained, the established particle diameter of coarse powder to be removed is usually 10 to 20 μm depending on the particle-size distribution of the fine pulverized material T2. When the volume-average particle diameter of the coarse powder T3 classified by the coarse-powder classifier 5 is 3 (μm), the difference (D3−D2 ) between D3 and the volume-average particle diameter D2 (μm) of the finely pulverized material obtained in the second pulverizer should be established to be 6 μm or less. Therefore fine pulverization is carried out in the second pulverizer such that a finely pulverized material having such volume-average particle diameter can be obtained. When D3−D2 is greater than 6 μm, there arises a problem that the amount of the returning powder is increased to prevent the pulverizing capacity from increasing. The classified coarse powder T4 is discharged as returning powder from the coarse-powder classifier 5 and sent to the returning-powder feeder 6. For efficient and stable operation of the toner pulverization system, the amount of the classified coarse powder classified from the finely pulverized material should be small and stable. In the present invention, the first and second pulverizers are operated such that D1−D2 is in the range of 3 to 6 μm as described above or D3−D2 is in the range of 6 μm or less, whereby the amount of the classified coarse powder can be decreased and stabilized.

In the present invention, the coarse-powder classifier 5 may be any known powder classifier and is not particularly limited. Examples of the classifier include air stream classifiers free of a rotating part therein and classifying a sample with only an air stream, such as DS or DSX classifiers manufactured by Nippon Pneumatic Kogyo, Elbow Jet Classifier utilizing coanda effect (manufactured by Nittetsu Mining Mfg. Co., Ltd.), and mechanical classifiers classifying a sample with an air stream generated by rotation of a rotating blade, for example MS Classifier (manufactured by Hosokawa Micron Corporation), Turbo Plex Classifier (manufactured by Hosokawa Micron Corporation), Fine Sector Classifier (manufactured by Kawasaki Heavy Industries, Ltd.), Turbo Classifier (manufactured by Nisshin Engineering Inc.) etc. Among these classifiers, air stream classifiers are particularly preferred in the present invention. This is because physical contact of fine powder with a rotating blade or a rotating plate, which occurs upon classification in mechanical classifiers, does not occur in the air stream classifiers so that there does not arise the problem of fusion by physical contact of the finely pulverized material with the inside of the classifier. In the air stream classifier, even if the temperature in the classifier is increased upon classification, the fusion of the pulverized material to members in the air stream classifier hardly occurs, a shift in the particle-size distribution of the finely pulverized material from which coarse powder was separated is not occurred, and the operation can be conducted stably for a long time. Further, scattering coarse particles into a gap between driving parts can be prevented, and the air stream classifier is also advantageous in that aggregates can be collapsed and cleared away by the presence of coarse powder.

The returning-powder feeder 6 in the present invention is provided with a weighing device for weighing the classified coarse powder stored in the returning-powder feeder, and provided with a switching device for changing the supplying amount of the coarse powder T3, which is sent to the returning-powder feeder 6, to the second pulverizer 4. As a method for measuring the weight of the classified coarse powder stored in the returning-powder feeder, the following method is usually adopted. That is, the weight W2 of the whole of the returning-powder feeder storing the coarse powder is measured, and the previously measured weight W1 of the returning-powder feeder itself not storing the classified coarse powder is subtracted from W2. From the value of (W2−W1), the weight of the classified coarse powder stored in the returning-powder feeder is determined. Depending on the weighing result determined by the weighing device, the classified coarse powder T3 is fed as returning powder in a quantitative amount (F3) to the second pulverizer. The amount of the returning powder fed to the second pulverizer is changed by arbitrary means, for example by switching the number of revolutions of a rotary feeder arranged in the returning-powder feeder. Switching is conducted in multiple stages; for example, when the weight of the classified coarse powder in the returning-powder feeder becomes the minimum value in the predetermined range, the coarse powder T3 is fed in an established amount F31 which is smaller than the amount of the classified coarse powder fed in usual operation to the returning-powder feeder, while the weight of the classified coarse powder in the returning-powder feeder becomes the maximum value in the predetermined range, the coarse powder T3 is fed in an established amount F32 which is larger than the amount of the classified coarse powder fed in usual operation to the returning-powder feeder. For stable operation of the apparatus, the changed amount of the returning powder fed to the second pulverizer is within ±20% relative to the amount of the moderately pulverized material fed to the second pulverizer. Accordingly, pulverization in the second pulverizer should be conducted so as to give a finely pulverized material having narrow particle-size distribution and less change in particle-size distribution such that the amount of the classified coarse powder is small and always constant. The amount of the classified coarse powder fed is preferably lower than 50% of the finely pulverized material.

From the view point of safety, following method may be adopted. That is, the other minimum value that is lower than the predetermined minimum value is separately established, or the other maximum value that is greater than the predetermined maximum value is separately established. When the separately established minimum or maximum value is detected, the classified coarse powder is quantitatively fed in an amount smaller or larger than the predetermined amount of the powder fed. When the amount of the classified coarse powder is switched between the maximum and minimum amounts in the above-mentioned predetermined range, two-stage switching is conducted, while 3- or 4-stage switching is conducted in the case of the safety design described above. Further, 5-stage or more switching may be conducted, but usually 2-stage switching is sufficient in the method of the present invention. For enabling stable operation of the apparatus without frequent changing of the switch, it is preferred for the amount of the fed material to be switched such that the changing amount of the returning powder fed is established within ±20% relative to the amount of the moderately pulverized material fed to the second pulverizer.

As the method of measuring the weight of the returning-powder feeder, there is specifically a method of arranging the returning feeder itself on a weighing device such as a load cell. For storing the classified coarse powder in the quantitative returning-powder feeder, however, it is usually necessary that circulation of air through the pulverization system is blockaded by a device such as a double dumper arranged in a coarse powder discharge opening of the coarse-powder classifier, and an upper part of the returning-powder feeder is dissociated such that other weight (weight other than the weight of the returning-powder feeder and the classified coarse powder in the returning-powder feeder) is not measured. The term "dissociated" means that the weight of the upper and lower parts does not exert any influence on the weight of the material to be measured. That is, it refers not only to complete separation but also to the state where by sagging soft vinyl plastic or the like, the weight of the upper and lower parts is not added to the weight of the material to be measured, or to the state where a predetermined weight of the upper and lower parts is always added to the weight of the material to be measured. The determined weight is sent as data to a recorder, and as described above, the amount of the material fed is switched in at least two or more stages depending on an increase or decrease in the weight as described above. One method of switching the measurement amount depending on the weight is illustrated as follows.

First, an inverter motor is used as a feeder for feeding the classified coarse powder T3 to the second pulverizer and arranged in a dissociated state on a load cell. The output of the weight of the load cell is recorded by a recorder. As the recorder, an alarm recorder is used, and the minimum weight is established. The minimum weight is preferably the weight at the time when there exists powder of about 5 cm or more in height on a pressure-control plate arranged in the feeder. Then, the amount of the powder fed in usual operation and the amount of the powder (upon correction of the weight) fed in an amount lower than the predetermined amount are established as the frequency of the inverter motor. The establishment is made such that when the weight of the load cell becomes the minimum level, the feeder is operated by the frequency of the established feed amount F31 that is smaller than the amount of the classified coarse powder fed in usual operation to the returning-powder feeder, and when the weight of the load cell becomes the maximum level, the feeder is operated by the frequency of the established feed amount F32 that is higher than the amount of the classified coarse powder fed in usual operation to the returning-powder feeder by a sequencer and/or a relay circuit. Time lag (about 1 to 10 minutes) until switching is established preferably such that the control of the switch is not too frequently conducted by an increase or decrease in the weight of the feeder. Thus, the change of the amount of the coarse powder fed to the feeder can be conducted depending on the weight of the coarse-powder feeder.

On the other hand, the finely pulverized material T5 from which coarse powder was removed is classified by the fine-powder classifier 7 to remove fine powder having a predetermined particle diameter or less, and if necessary mixed with a external additive in the mixer 8, to give a pulverized product, that is, an electrostatic charge image developing toner. The fine-powder classifier 7, similar to the coarse-powder classifier, may be used any known classifier. The classified fine powder is captured by the cyclone 9, and exhaust gas from the cyclone is passed through the bug filter 10 to separate fine powder from the exhaust gas, and then discharged through the blower 11. As the mixer 8, a mixer having a high-speed rotating blade, such as Super Mixer (manufactured by Kawata Mfg. Co., Ltd.) or Henschel mixer (manufactured by Mitsui Mining Company Limited), is preferably used. If necessary, the classified material can be treated with High Britizer (manufactured by Nara Machinery Co., Ltd.). Further the resulting mixture is sieved to remove aggregates from the mixture, if necessary. As the sieving method and a device therefor, mention can be made of conventionally known ones such as a method of sieving with vibration generated by a motor [circular vibration sieve (manufactured by Dalton Corporation) or Gyro Sifter (manufactured by Tokuju Corporation)], a method of sieving by vibration with sound waves [Pul Finer (manufactured by Tokuju Corporation) etc.], a method of sieving by vibration with supersonic waves [ultrasonic vibrating sieve (manufactured by Tokuju Corporation) etc.], a method of sieving by using an air stream [High Bolta (manufactured by Toyo Hitec Co., Ltd.) etc.]. The size of openings in a sieving net is usually 35 to 300 μm, and a known mesh such as a twill weave or plain weave net can be used, and its material may be stainless steel, nylon or the like.

The method of producing an electrostatic charge image developing toner according to the present invention and the production apparatus therefor have been described specifically, and hereinafter, toner materials used preferably in the method of producing an electrostatic charge image developing toner according to the present invention, and production of the pulverized starting material, are described in more detail.

As described above, the pulverized starting material (flakes) for production of the electrostatic charge image developing toner according to the present invention can be produced by use of conventionally known materials as the toner component and a conventionally known method. That is, as the toner constituting material, a binder resin, a charge control agent, a colorant and other additives are usually used. The pulverized starting material is produced by mixing these materials preliminarily in a mixer such as a dry blender, a ball mill or a Henschel mixer, melt-kneading the mixture well in a mixer such as a heat roll, a kneader or a single- or twin-screw extruder, cooling and solidifying, and mechanically pulverizing with a pulverizer such as a hammer mill. The particle diameter of the pulverized starting material is preferably 3 mm or less as described above. Therefore after pulverization, the material is sieved depending on necessity to get particles larger than 3 mm out from the pulverized material, and the material passing through a sieve is used as the pulverized starting material. As described above, the material constituting the toner powder in the present invention may be any material used in conventional toners for developing an electrostatic charge image. Hereinafter, the material constituting the toner is described in more detail.

The binder resin in the electrostatic charge image developing toner may be any conventional toner binder resin. Specific examples of the binder resin include homopolymers of styrene and derivatives thereof, such as polystyrene, poly-p-chlorostyrene and polyvinyl toluene; styrene-styrene derivative copolymers such as styrene/p-chlorostyrene copolymer and styrene/vinyl toluene copolymer; and styrene-based copolymers such as styrene/vinyl naphthalene copolymer, styrene/acrylic acid-based copolymer, styrene/methacrylic acid-based copolymer, styrene/methyl α-chloromethacrylate copolymer, styrene/acrylonitrile copolymer, styrene/vinyl methyl ether copolymer, styrene/vinyl ethyl ether copolymer, styrene/vinyl methyl ketone copolymer, styrene/butadiene copolymer, styrene/isoprene copolymer and styrene/acrylonitrile/indene copolymer, as well as polyvinyl chloride, phenol resin, natural resin modified phenol resin, natural resin modified maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, chroman indene resin, and petroleum resin.

Particularly preferable among those described above are a styrene homopolymer, styrene/styrene derivative copolymer, styrene/acrylic acid-based copolymer and styrene/methacrylic acid-based copolymer. The comonomer for the styrene monomer in the styrene/acrylic acid-based copolymer or styrene/methacrylic acid-based copolymer includes, for example, acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate and octyl methacrylate.

A crosslinked styrene-based copolymer is also a preferable binder resin. As co-monomers used together with styrene in producing the crosslinked styrene-based copolymer, there are illustrated vinyl monomers such as the above styrene derivatives; monocarboxylic acids or derivatives thereof having a double bond such as acrylic acid, methacrylic acid, acrylates, methacrylates, and acrylamide; acrylonitrile and methacrylonitirle; dicarboxylic acids or derivatives thereof having a double bond, such as maleic acid, methyl maleate, butyl maleate and dimethyl maleate; vinyl chloride; vinyl esters such as vinyl acetate and vinyl benzoate; ethylene-based olefins such as ethylene, propylene and butylene; vinyl ketones such as vinyl methyl ketone and vinyl hexyl ketone; and vinyl ethers such as vinyl methyl ether, vinyl ethyl ether and vinyl isobutyl ether. These are used singly or as a mixture of two or more thereof.

As the crosslinking agent, a compound having two or more polymerizable double bonds is mainly used. The examples of the crosslinking agent include, for example, aromatic divinyl compounds such as divinyl benzene and divinyl naphthalene; carboxylates having two double bonds, such as ethylene glycol diacrylate, ethylene glycol dimethacrylate, 1,3-butanediol dimethacrylate, polyethylene glycol diacrylate and polyethylene glycol dimethacrylate; divinyl compounds such as divinyl aniline, divinyl ether, divinyl sulfide and divinyl sulfone; and compounds having three or more vinyl groups. These are used alone or as a mixture of two or more thereof. These crosslinking agents are used in an amount of about 0.01 to 5 parts by weight, more preferably about 0.03 to 3 parts by weight, based on 100 parts by weight of the other monomer component.

In respect of fixing ability, the binder resin is preferably a styrene-based copolymer having at least one peak in the region of $3\times10^3$ to $5\times10^4$ and at least one peak or shoulder in the region of $10^5$ or more in its molecular-weight distribution determined by GPC. The binder resin having such molecular-weight distribution can be produced by mixing two or more resins different in average molecular weight or by forming crosslinked resin by use of the above crosslinking agent.

The molecular-weight distribution by GPC is measured and determined, for example, under the following conditions.

A column is stabilized in a heat chamber at 40° C., and tetrahydrofuran (THF) as solvent is passed through the column at a flow rate of 1 ml/min. under the above temperature, and about 100 μl sample solution in THF is injected and measured. To measure the molecular weight of the sample, the molecular-weight distribution of the sample is determined from the relationship between counts and the corresponding logarithmic values in a calibration curve prepared using several kinds of monodisperse polystyrene standards.

The polystyrene standards used in preparation of the calibration curve are those having molecular weights of about $10^2$ to $10^7$ manufactured, for example, by Tosoh Corporation or Showa Denko K.K., and it is suitable to employ at least 10 polystyrene standards. As the detector, an RI (refractive index) detector is used. As the column, combination of plural commercial polystyrene gel columns is preferred. For example, a combination of Shodex GPC KF-801, 802, 803, 804, 805, 806, 807 and 800P manufactured by Showa Denko K.K. or a combination of TSK gel G1000H (HXL), G2000H (HXL), G3000H (HXL), G4000H (HXL), G5000H (HXL), G6000H (HXL), G7000H (HXL) and TSK guard column manufactured by Tosoh Corporation can be mentioned.

The measurement sample is prepared in the following manner. That is, a sample is added to THF, left for several hours, shaken sufficiently, mixed well with the THF until aggregates of the sample disappear, and then the sample is left for 12 hours or more. In this procedure, the sample shall be left for 24 hours or more in THF. Thereafter, the sample is filtered through a sample treatment filter (0.45 to 0.5 μm pore size, for example, Myshori Disk H-25-5 manufactured by Tosoh Corporation or Liquid-Chromatographic Disk 25CR manufactured by Geruman Science Japan) to give a GPL measurement sample. The concentration of the sample is regulated such that the resin component is at a concentration of 0.5 to 5 mg/ml.

In production of a vinyl polymer, a polymerization initiator is used, and the polymerization initiator used may be any initiator known in the art. A polymerization initiator such as benzoyl peroxide, lauroyl peroxide, tert-butyl hydroperoxide, tert-butyl peroxy benzoate, di-tert-butyl peroxide, cumene hydroperoxide, dicumyl peroxide, azoisobutyronitrile or azobisvaleronitrile is preferably used in usual. The initiator is used generally in an amount of 0.2 to 5 wt % based on the vinyl monomer. The polymerization temperature is selected suitably depending on the type of monomer and initiator used.

Polyester resin is also preferred as the binder resin in the electrostatic charge image developing toner. The alcohol component constituting the polyester resin includes polyvalent alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, diols such as bisphenol derivatives represented by formula 1 below, glycerin, sorbitol and sorbitan.

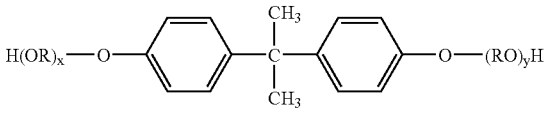

wherein R is an ethylene or propylene group, each of x and y is an integer of 1 or more, and the sum of x and y is 2 to 10 on average.

The acid component constituting the polyester resin includes divalent carboxylic acids, for example, benzenedicarboxylic acids such as phthalic acid, terephthalic acid, isophthalic acid and phthalic anhydride, or anhydrides thereof; alkyl dicarboxylic acids such as succinic acid, adipic acid, sebacic acid and azelaic acid, or anhydrides thereof; succinic acid substituted with a C16 to C18 alkyl group or anhydrides thereof; unsaturated dicarboxylic acids such as fumaric acid, maleic acid, citraconic acid and itaconic acid, or anhydrides thereof; and trivalent or more carboxylic acids such as trimellitic acid, pyromellitic acid and benzophenone tetracarboxylic acid, or anhydrides thereof.

Preferable examples of the alcohol component include bisphenol derivatives represented by formula 1 above, and preferable examples of the acid component include dicarboxylic acids such as phthalic acid, terephthalic acid, isophthalic acid or anhydrides thereof, succinic acid, n-dodecenyl succinic acid or anhydrides thereof, fumaric acid, maleic acid and maleic anhydride and tricarboxylic acids such as trimellitic acid or anhydrides thereof.

When the pressure fixing system is used, binder resin for pressure fixing toner can be used, and examples of such binder resin include polyethylene, polypropylene, polymethylene, polyurethane elastomer, ethylene/ethyl acrylate copolymer, ethylene/vinyl acetate copolymer, ionomer resin, styrene/butadiene copolymer, styrene/isoprene copolymer, linear saturated polyester and paraffin.

As the colorants, any known colorants to be used in producing toners can be used. The colorants include, for example, black colorants such as carbon black, aniline black, acetylene black and iron black, and other colorants such as various dye or pigment compounds based on phthalocyanine, rhodamine, quinacridone, triaryl methane, anthraquinone, azo, diazo, methine, allylamide, thioindigo, naphthol, isoindolinone, diketopyroropyrrole and benzimidazolone, their metal complexes and lake compounds. These can be used alone or as a mixture of two or more thereof.

As the magnetic powder, any powder of an alloy, compound etc. containing ferromagnetic elements used conventionally in producing magnetic toners can be used. Examples of such magnetic powder include powders of iron oxides or divalent metal/iron oxide compounds such as magnetite, maghemite and ferrite, metals such as iron, cobalt and nickel, alloys between these metals and metals such as aluminum, cobalt, copper, lead, magnesium, tin, zinc, antimony, beryllium, bismuth, cadmium, calcium, manganese, serene, titanium, tungsten and vanadium, and mixtures thereof. These magnetic powders are preferably those having an average particle diameter of about 0.05 to 2 μm, more preferably about 0.1 to 0.5 μm. The content of the magnetic powder in the toner is about 5 to 200 parts by weight, preferably 10 to 150 parts by weight, based on 100 parts by weight of the binder resin. The saturation magnetization of the toner is preferably 15 to 35 emu/g (measurement magnetic field, 1 kilo-oersted).

The charge control agent may be any charge control agent conventionally used for an electrostatic charge image developing toner, and the charge control agent for positively charging the toner includes electron donative substances such as nigrosine dyes (see, for example, JP-B48-25669), basic dyes such as triarylmethane dyes, quaternary ammonium salts (see, for example, JP-A57-119364), organotin oxides (see, for example, JP-B 57-29704) and polymers having amino group(s), while the charge control agent for negatively charging the toner includes, for example, metal complexes of monoazo dyes, metal-containing dyes such as chrome-containing organic dyes (copper phthalocyanine green, chrome-containing azo dyes), metal complexes of aryloxy carboxylic acid such as salicylic acid (see, for example, JP-B 55-42752) and divalent or trivalent metal salts thereof (see, for example, JP-A 11-255705 and JP-B 7-62766).

Other constituent materials such as a release agent, a lubricant, a fluidity improver, an abrasive, an electroconductivity imparting agent and an image release inhibitor may be added as an internal or external agent to the toner. The release agent includes, for example, waxy substances such as low-molecular polyethylene, low-molecular polypropylene, microcrystalline wax, carnauba wax, sasol wax, paraffin wax, montan wax, fatty acid amide wax, and aliphatic acid metal salts, and these are added to the toner usually in an amount of about 0.5 to 5 wt %. The lubricant includes polyvinylidene fluoride, zinc stearate or the like, the fluidity improver includes silica produced in a dry or wet process, aluminum oxide, titanium oxide, silicon aluminum co-oxide, silicon titanium co-oxide or an afore-mentioned material to which a hydrophobicity imparting treatment is carried, the abrasive includes silicon nitride, cerium oxide, silicon carbide, strontium titanate, tungsten carbide, calcium carbonate or an afore-mentioned material to which a hydrophobicity imparting treatment is carried, and the electroconductivity imparting agent includes carbon black, tin oxide or the like. Fine powder of a fluorine-containing polymer such as polyvinylidene fluoride is preferred in respect of fluidity, polishing and charge stabilization. A hydrophobicity-imparting agent for fine powder used as the fluidity improver includes silane coupling agents such as silicon oil, dichlorodimethyl silane, hexamethyl disilazane and tetramethyl disilazane. When the fluidity improver or abrasive is added as an external agent, the amount of the former is 0.01 to 20%, preferably 0.03 to 5%, and the amount of the latter is 0.05 to 5.0%, preferably 0.3 to 3.0%, based on the weight of the toner powder.

In the present invention, the volume-average particle diameter of the toner particles in a toner product is preferably 3 to 20 μm, more preferably 5 to 12 μm. To obtain such volume-average particle diameter, the volume-average particle diameter D1 of the moderately pulverized material T1, the volume-average particle diameter D2 of the finely pulverized material T2, the established classified particle diameter R3 of the classified coarse powder T3, and the established classified particle diameter R4 upon separation of fine powder in the finely pulverized material T4 from which coarse powder was separated are established. For example, when a toner having a volume-average particle diameter of 8.5 μm is to be obtained as a toner product, D1, D2, R3 and R4 are determined such that for example, D1 is 13 μm, D2 is 8 μm, R3 is 12 μm, and R4 is 5 μm. When a toner having a volume-average particle diameter of 10.5 μm is to be obtained as a toner product, D1, D2, R3 and R4 are determined such that for example, D1 is 14 μm, D2 is 10 μm, R3 is 15 μm and R4 is 5 μm.

In the method of producing an electrostatic charge image developing toner according to the present invention, both the first and second pulverizers are mechanical pulverizers, and thus the circularity of the resulting pulverized product is higher than that of a product obtained by a collision pulverizer using a jet air stream, to improve the fluidity of the resulting pulverized product. In the present invention, pulverization is conducted in the two pulverizers connected in series, and thus the finely pulverized product obtained by the second pulverizer is a pulverized product in a stable shape having higher circularity, lower standard deviation of the circularity and higher fluidity than those of a finely pulverized product obtained by one mechanical pulverizer. By connecting two mechanical pulverizers in series, the efficiency of pulverization is about 1.5 times as high as in the case of pulverization with two mechanical pulverizers connected in parallel. Therefore the energy of production of the toner per unit weight can be decreased. According to the production method of the present invention, the classified product having a predetermined average particle diameter can be produced stably for a long time and the number of workers in a manufacturing factory can be reduced, and automatic operation is also feasible.

According to the production method of the present invention, the amount of the returning powder is low, and a classified product having an excellent shape can be produced stably from the start of production. An electrostatic charge image developing toner obtained from the resulting classified product is superior in fluidity and excellent in development properties.

EXAMPLES

Hereinafter, the present invention is described in more detail by reference to the Examples, but the present invention is not limited by the Examples.

In the following description, the term "parts" refers to parts by weight. The mean circularity is a numerical value calculated based on the numbers of particles.

Example 1

57 parts by weight of styrene acrylic binder resin, 40 parts by weight of magnetic powder (magnetite), 1 part by weight of a charge control agent (nigrosine base), and 2 parts by weight of polypropylene wax were preliminarily mixed by a mixer. The resulting mixture was melt-kneaded by a continuous kneader, and then the kneaded mixture was cooled and solidified. The solidified product was pulverized to a size of 3 mm or less and used as the pulverized starting material.

An electrostatic charge image developing toner was produced by a pulverization system shown in FIG. 1 wherein two mechanical pulverizers 2 and 4 were connected in series and the second mechanical pulverizer 4 had a closed system. In a production system of an electrostatic charge image developing toner in Example 1, Table Feeder FS-Q produced by Funken Powtechs, Inc. was used as each of pulverized starting material quantitative feeder 1, moderately pulverized material quantitative feeder 3, and returning-powder quantitative feeder 6, and a mechanical pulverizer, KTM-2 manufactured by Kawasaki Heavy Industries, Ltd. was used as each of first pulverizer 2 and second pulverizer 4. Additionally an air stream classifier DS-10 manufactured by Nippon Pneumatic Mfg. Co., Ltd. was used as coarse-powder classifier 5, and a rotation classifier, Classifier MS-2 manufactured by Hosokawa Micron Corporation was used as fine-powder classifier 7. Then, the amount F1 of the pulverized starting material from the pulverized starting material quantitative feeder 1 was established to be 100 kg/hr, and the conditions for each unit were established as follows such that toner powder having an average particle diameter of 10.5±0.3 μm could be obtained as the pulverized product. That is, first, the number of revolutions of a rotor in the first pulverizer 2 was established to be 6,000 rpm such that the objective particle diameter of the moderately pulverized material became 14±0.5 μm in the volume-average particle diameter $D_{50}$, and the number of revolutions of a rotor in the second pulverizer was established to be 4,000 rpm such that the objective particle diameter of the finely pulverized material became 10±0.5 μm in the volume-average particle diameter $D_{50}$. The amount F2 of the pulverized material supplied from the moderately pulverized material quantitative feeder 3 to the second pulverizer 4 was established to be 100 kg/hr that was the same as the amount F1 of the pulverized starting material. The coarse-powder classifier 5 was established such that coarse powder having a particle diameter exceeding 15 μm was classified and removed. The amount F3 of the returning powder from the returning-powder quantitative feeder 6 was established in two stages of 37 kg/hr and 30 kg/hr and established to be 37 kg/hr as first. Switching of the amount of the returning powder to be supplied from 37 kg/hr to 30 kg/hr was conducted after 1 minute from the time when the amount of the classified coarse powder in the returning-powder quantitative feeder 6 was detected to be the established minimum amount by measuring the weight of the returning-powder quantitative feeder 6, and switching of the amount from 30 kg/hr to 37 kg/hr was conducted after 1 minute from the time when the amount of the classified coarse powder in the returning-powder quantitative feeder 6 was detected to be the established maximum amount by measuring the weight of the returning-powder quantitative feeder 6. The fine powder classifier 7 was established such that fine powder having a particle diameter of less than 5 μm was classified and removed.

Under the conditions described above, the operation was conducted for 48 hours to produce a toner. The resulting classified product was sampled every hour and measured for particle-size distribution and circularity. The results including the production conditions with respect to typical elapsed time are shown in Tables 1-A and 1-B.

The particle-size distribution is measured by the following measurement method.

[Method of Measuring the Particle-size Distribution]

In measurement of particle-size distribution, Coulter Counter-Multisizer II manufactured by Beckman Coulter, Inc. was used to determine the volume-average particle diameter.

For measurement, 1% aqueous NaCl solution using first-grade sodium chloride was prepared as an electrolysis solution. For example, ISOTON R-II (manufactured by Coulter Scientific Japan) can be used. The measurement method involves adding 0.1 to 5 ml surfactant, preferably alkyl benzene sulfonate as a dispersant, to 100 to 150 ml of the aqueous electrolysis solution and further adding 2 to 20 mg measurement sample thereto. The electrolysis solution having the sample suspended therein was dispersed for 1 to 3 minutes with an ultrasonic dispersing unit, and the volume and numbers of toners having 2 μm or more in diameter were measured with a 100 μm aperture by the above measuring instrument to determine the volume distribution and number distribution of the particles. The volume-average particle diameter was determined from the volume distribution.

TABLE 1-A

| | Operation time (hr.) | | | | | |
|---|---|---|---|---|---|---|
| | 0 | 0.5 | 1 | 2 | 4 | 8 |
| Amount of starting material fed (kg/hr) (F1) | 100 | 100 | 100 | 100 | 100 | 100 |
| Amount of pulverized product in first stage to be fed to second pulverizer (kg/hr) (F2) | 100 | 100 | 100 | 100 | 100 | 100 |
| Amount of returning powder | — | 35 | 36 | 34 | 35 | 33 |
| Amount of returning powder fed (kg/hr) (F3) | — | 37 | 37 | 37 | 37 | 30 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6000 | 6000 | 6000 | 6000 | 6000 | 6000 |
| Motor power (kw) in first-stage pulverizer | 18.0 | 17.5 | 18.0 | 18.0 | 18.0 | 17.5 |
| Number of revolution in second-stage pulverizer (rpm) | 4000 | 4000 | 4000 | 4000 | 4000 | 4000 |
| Motor power (kw) in second-stage pulverizer | 15.5 | 15.5 | 15.5 | 15.5 | 15.5 | 15.5 |
| (Particle size) | | | | | | |
| Volume-average particle diameter D50 after first-stage pulverization | — | 14.1 | 13.9 | 14.0 | 14.2 | 13.9 |
| Volume-average particle diameter D50 after second-stage pulverization | — | 9.9 | 9.8 | 9.9 | 9.8 | 10.0 |
| Volume-average particle diameter D50 of coarse powder in second stage | — | 15.5 | 15.4 | 15.3 | 15.5 | 15.6 |
| Volume-average particle diameter D50 of classified product | | 10.5 | 10.4 | 10.3 | 10.3 | 10.6 |
| Mean circularity of first-stage pulverized product | — | 0.891 | 0.890 | 0.893 | 0.889 | 0.892 |
| Mean circularity of final classified product | — | 0.911 | 0.909 | 0.910 | 0.912 | 0.912 |
| Mean circularity of final classified product (standard deviation) | — | 0.060 | 0.057 | 0.059 | 0.058 | 0.057 |

TABLE 1-B

| | Operation time (hr.) | | | | | |
|---|---|---|---|---|---|---|
| | 16 | 24 | 32 | 40 | 48 | total |
| Amount of starting material fed (kg/hr) (F1) | 100 | 100 | 100 | 100 | 100 | |
| Amount of pulverized product in first stage to be fed to second pulverizer (kg/hr) (F2) | 100 | 100 | 100 | 100 | 100 | |
| Amount of returning powder | 35 | 35 | 34 | 33 | 36 | |
| Amount of returning powder fed (kg/hr) (F3) | 37 | 37 | 37 | 30 | 37 | |
| Amount of final classified material (kg) | | | | | | 4320 |
| Amount of classified fine powder (kg) | | | | | | 480 |
| Yield of final classified product (%) | | | | | | 90 |
| Amount of final classified product produced per hour (kg) | | | | | | 90 |
| (Process conditions) | | | | | | |
| Number of revolution in first-stage pulverizer (rpm) | 6000 | 6000 | 6000 | 6000 | 6000 | |
| Motor power (kw) in first-stage pulverizer | 18.0 | 18.0 | 18.0 | 18.0 | 18.0 | |
| Number of revolution in second-stage pulverizer (rpm) | 4000 | 4000 | 4000 | 4000 | 4000 | |
| Motor power (kw) in second-stage pulverizer | 15.5 | 15.5 | 15.5 | 15.5 | 15.5 | |
| (Particle size) | | | | | | |
| Volume-average particle diameter d50 after first-stage pulverization | 14.1 | 14.1 | 14.1 | 13.9 | 14.0 | |
| Volume-average particle diameter d50 after second-stage pulverization | 10.0 | 9.8 | 9.7 | 10.0 | 10.0 | |

TABLE 1-B-continued

| | Operation time (hr.) | | | | | |
|---|---|---|---|---|---|---|
| | 16 | 24 | 32 | 40 | 48 | total |
| Volume-average particle diameter d50 of coarse powder in second stage | 15.4 | 15.2 | 15.3 | 15.3 | 15.3 | |
| Volume-average particle diameter d50 of classified product | 10.5 | 10.3 | 10.4 | 10.5 | 10.5 | |
| Mean circularity of first-stage pulverized product | 0.890 | 0.893 | 0.894 | 0.889 | 0.890 | |
| Mean circularity of final classified product | 0.911 | 0.910 | 0.911 | 0.913 | 0.912 | |
| Mean circularity of final classified product (standard deviation) | 0.060 | 0.061 | 0.059 | 0.057 | 0.057 | |

As can be seen from Tables 1-A and 1-B, a toner particle (a) was obtained at 90 kg/hr from the starting material supplied at 100 kg/hr. Accordingly, the toner yield was 90%. The toner particle (a) (classified product) was produced continuously for 48 hours under the conditions described above, but the particle-size distribution was hardly changed without regulation, and the classified product having an average particle diameter in the range of 10.5±0.3 μm was obtained stably. The standard deviation of circularity of the classified product was 0.06 or less.

In the subsequent post-treatment, the toner particle (a) was subjected to mixing and sieving to give a toner. In the post-treatment of surface-treatment by additives, 60 kg of the toner particle (a) obtained by the pulverization system above, 150 g hydrophobic silica and 180 g fine tungsten carbide powder were mixed by a mixer (Henschel mixer FM300L manufactured by Mitsui Mining Co., Ltd.) for 60 seconds under the condition of 30 m/sec. The resulting mixture was sieved through 106-μm openings with a supersonic sieve (manufactured by Dalton) to give a magnetic toner (A). The charge on this magnetic toner was 15.3 μc/g. By using the magnetic toner (A) in a commercial copier (NP3050 manufactured by Canon Inc.), a copying test was conducted at ordinary temperature (23° C.) and ordinary humidity (50% RH) thus evaluating the density of an toner image (initial image density and image density after 10,000 sheets) and the background fog density-(initial background fog density and background fog density after copying 10,000 sheets), and measuring the amount of the toner consumed in development and the toner dusting in the machine. The results are shown in Table 9 below.

The charge on the magnetic toner, the image density, the background fog density, the amount of the consumed toner, and the toner dusting in the machine were measured according to the following methods.

[Measurement of the Charge on the Magnetic Toner]

Cu—Zn ferrite carrier particles having an average particle diameter of 80 to 120 μm and the toner sample were weighed such that the concentration of the toner became 5 wt % based on their total amount, and then they were mixed by a ball mill or the like, and the charge on the toner was measured by a blow-off charge measuring instrument. Specifically, measurement was conducted in the following method.

19.0 g Cu—Zn ferrite carrier cores (trade name: F-100) manufactured by Powder-tech Corporation and 1.0 g toner sample were weighed and put into a 50 cc plastic bottle, followed by shaking the bottle 5 times and mixing for 30 minutes at 230 rpm (with the plastic bottle rotated at 120 rpm) as measured value with a ball mill (PLASTIC PLANT SKS manufactured by Shinei Koki Sangyo).

The sample obtained after mixing was measured for its charge by a blow-off charge-measuring instrument manufactured by Toshiba Chemical Corporation. The maximum value for a measurement time of 20 seconds was read under a blow pressure of 1 kgf/cm$^2$, and at this time a net with 400-mesh size was used. The measurement was conducted under the conditions of 23° C., 50% RH.

[Measurement of Image Density]

The image density was measured with a Macbeth photodensitometer, RD918. A density of 1.35 or more is preferable image density.

[Measurement of Fog Density]

Fog density was determined by measuring its reflectance by PHOTOVOLT (MODEL 577). 1.5% or less is a preferable value.

[Calculation of the Amount of the Consumed Toner]

A manuscript having a blackness of 6% was actually copied, and the amount (g) of the toner consumed every 1,000 sheets was indicated.

[Measurement of the Toner Dusting in the Machine]

The state of the toner dusting on a transfer charger in the developing machine after the image test was confirmed with naked eyes.

Example 2

A toner was produced in the same manner as in Example 1 except that the first pulverizer KTM-2 in the first stage was replaced by KTM-E2 having a longer rotor and higher motor power, and accordingly the number of revolutions of a rotor in the first and second pulverizers and the amounts of the pulverized starting material, the moderately pulverized material and the returning powder fed to the pulverizers were changed as shown in Table 2. The process conditions and results at each elapsed time are shown in Tables 2-A and 2-B.

TABLE 2-A

| | Operation time (hr.) | | | | | |
|---|---|---|---|---|---|---|
| | 0 | 0.5 | 1 | 2 | 4 | 8 |
| Amount of starting material fed (kg/hr) (F1) | 140 | 140 | 140 | 140 | 140 | 140 |
| Amount of pulverized product in first stage to be fed to second pulverizer (kg/hr) (F2) | 140 | 140 | 140 | 140 | 140 | 140 |

TABLE 2-A-continued

| | Operation time (hr.) | | | | | |
|---|---|---|---|---|---|---|
| | 0 | 0.5 | 1 | 2 | 4 | 8 |
| Amount of returning powder | — | 50 | 55 | 60 | 55 | 55 |
| Amount of returning powder fed (kg/hr) (F3) | — | 40 | 60 | 60 | 60 | 60 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6200 | 6200 | 6200 | 6200 | 6200 | 6200 |
| Motor power (kw) in first-stage pulverizer | 24.0 | 23.5 | 24.0 | 23.5 | 24.0 | 23.5 |
| Number of revolution in second-stage pulverizer (rpm) | 5000 | 5000 | 5000 | 5000 | 5000 | 5000 |
| Motor power (kw) in second-stage pulverizer | 17.0 | 17.0 | 17.0 | 17.0 | 17.0 | 17.0 |
| (Particle size) | | | | | | |
| Volume-average particle diameter D50 after first-stage pulverization | — | 14.2 | 14.0 | 14.1 | 14.3 | 14.1 |
| Volume-average particle diameter D50 after second-stage pulverization | — | 10.1 | 10.0 | 10.0 | 10.1 | 10.2 |
| Volume-average particle diameter D50 of coarse powder in second stage | — | 15.7 | 15.7 | 15.6 | 15.7 | 15.6 |
| Volume-average particle diameter D50 of classified product | | 10.6 | 10.6 | 10.5 | 10.5 | 10.5 |
| Mean circularity of first-stage pulverized product | — | 0.889 | 0.890 | 0.888 | 0.889 | 0.890 |
| Mean circularity of final classified product | — | 0.909 | 0.910 | 0.911 | 0.911 | 0.911 |
| Mean circularity of final classified product (standard deviation) | — | 0.066 | 0.065 | 0.063 | 0.060 | 0.061 |

TABLE 2-B

| | Operation time (hr.) | | | | | |
|---|---|---|---|---|---|---|
| | 16 | 24 | 32 | 40 | 48 | total |
| Amount of starting material fed (kg/hr) (F1) | 140 | 140 | 140 | 140 | 140 | |
| Amount of pulverized product in first stage to be fed to second pulverizer (kg/hr) (F2) | 140 | 140 | 140 | 140 | 140 | |
| Amount of returning powder | 50 | 55 | 60 | 55 | 50 | |
| Amount of returning powder fed (kg/hr) (F3) | 60 | 40 | 60 | 60 | 40 | |
| Amount of final classified product (kg) | | | | | | 6052 |
| Amount of classified fine powder (kg) | | | | | | 598 |
| Yield of final classified product (%) | | | | | | 91 |
| Amount of final classified product produced per hour (kg) | | | | | | 126 |
| (Process conditions) | | | | | | |
| Number of revolution in first-stage pulverizer (rpm) | 6200 | 6200 | 6200 | 6200 | 6200 | |
| Motor power (kw) in first-stage pulverizer | 23.5 | 23.5 | 24.0 | 23.5 | 24.0 | |
| Number of revolution in second-stage pulverizer (rpm) | 5000 | 5000 | 5000 | 5000 | 5000 | |
| Motor power (kw) in second-stage pulverizer | 17.0 | 17.0 | 17.0 | 17.0 | 17.0 | |
| (Particle size) | | | | | | |
| Volume-average particle diameter D50 after first-stage pulverization | 14.0 | 14.2 | 14.0 | 14.2 | 14.2 | |
| Volume-average particle diameter D50 after second-stage pulverization | 10.0 | 10.0 | 9.9 | 9.9 | 9.9 | |
| Volume-average particle diameter D50 of coarse powder in second stage | 15.5 | 15.5 | 15.7 | 15.6 | 15.5 | |
| Volume-average particle diameter D50 of classified product | 10.4 | 10.4 | 10.3 | 10.6 | 10.5 | |
| Mean circularity of first-stage pulverized product | 0.889 | 0.888 | 0.891 | 0.891 | 10.5 | |
| Mean circularity of final classified product | 0.910 | 0.912 | 0.912 | 0.911 | 0.891 | |
| Mean circularity of final classified product (standard deviation) | 0.062 | 0.064 | 0.064 | 0.062 | 0.061 | |

As can be seen from Tables 2-A and 2-B, KTM-E2 having higher performance was used as the pulverizer in the first stage, whereby the toner could be produced in a high yield of 91% and stably in the same manner as in Example 1, and simultaneously productivity could be improved.

The classified product produced in Example 2 was subjected to surface-treatment by additives in the same manner as in Example 1 to give a magnetic toner (B). For the magnetic toner (B), the measurement for the charge on the magnetic toner, the examination of the developed image, the measurement for the amount of the consumed toner, and the examination of toner dusting in the machine were conducted in the same manner as in Example 1. The results are shown in Table 9.

Example 3

A toner was produced in the same manner as in Example 1 except that the second pulverizer KTM-2 in the second stage was replaced by KTM-E2 having a higher motor power, and the each objective volume-average particle diameter $D_{50}$ of the moderately pulverized material and the finely pulverized material were established 14±0.5 μm and 8.2±0.5 μm respectively such that toner powder having a volume-average particle diameter $D_{50}$ of 8.5±0.3 μm could be obtained as the final classified product, and accordingly the operation conditions for each unit were changed as shown in Table 3. The results at each elapsed time are shown in Tables 3-A and 3-B.

TABLE 3-A

| | Operation time (hr.) | | | | | |
|---|---|---|---|---|---|---|
| | 0 | 0.5 | 1 | 2 | 4 | 8 |
| Amount of starting material fed (kg/hr) (F1) | 130 | 130 | 130 | 130 | 130 | 130 |
| Amount of pulverized product in first stage to be fed to second pulverizer (kg/hr) (F2) | 130 | 130 | 130 | 130 | 130 | 130 |
| Amount of returning powder | — | 40 | 50 | 50 | 45 | 40 |
| Amount of returning powder fed (kg/hr) (F3) | — | 30 | 45 | 45 | 45 | 45 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6000 | 6000 | 6000 | 6000 | 6000 | 6000 |
| Motor power (kw) in first-stage pulverizer | 18.0 | 18.0 | 18.0 | 18.0 | 18.0 | 18.0 |
| Number of revolution in second-stage pulverizer (rpm) | 4500 | 4500 | 4500 | 4500 | 4500 | 4500 |
| Motor power (kw) in second-stage pulverizer | 18.0 | 18.0 | 18.0 | 18.0 | 18.0 | 18.0 |
| (Particle size) | | | | | | |
| Volume-average particle diameter D50 after first-stage pulverization | — | 14.1 | 14.0 | 13.8 | 14.1 | 13.9 |
| Volume-average particle diameter D50 after second-stage pulverization | — | 8.1 | 8.3 | 8.2 | 8.3 | 8.3 |
| Volume-average particle diameter D50 of coarse powder in second stage | — | 13.9 | 14.1 | 13.7 | 13.8 | 14.1 |
| Volume-average particle diameter D50 of classified product | | 8.5 | 8.4 | 8.6 | 8.5 | 8.6 |
| Mean circularity of first-stage pulverized product | — | 0.890 | 0.888 | 0.889 | 0.891 | 0.892 |
| Mean circularity of final classified product | — | 0.921 | 0.920 | 0.918 | 0.919 | 0.918 |
| Mean circularity of final classified product (standard deviation) | — | 0.066 | 0.065 | 0.065 | 0.065 | 0.066 |

TABLE 3-B

| | Operation time (hr.) | | | | | |
|---|---|---|---|---|---|---|
| | 16 | 24 | 32 | 40 | 48 | total |
| Amount of starting material fed (kg/hr) (F1) | 130 | 130 | 130 | 130 | 130 | |
| Amount of pulverized product in first stage to be fed to second pulverizer (kg/hr) (F2) | 130 | 130 | 130 | 130 | 130 | |
| Amount of returning powder | 45 | 45 | 45 | 40 | 40 | |
| Amount of returning powder fed (kg/hr) (F3) | 45 | 30 | 30 | 45 | 30 | |
| Amount of final classified product (kg) | | | | | | 5544 |
| Amount of classified fine powder (kg) | | | | | | 685 |
| Yield of final classified product (%) | | | | | | 89 |
| Amount of final classified product produced per hour (kg) | | | | | | 115 |
| (Process conditions) | | | | | | |
| Number of revolution in first-stage pulverizer (rpm) | 6000 | 6000 | 6000 | 6000 | 6000 | |

TABLE 3-B-continued

| | Operation time (hr.) | | | | | |
|---|---|---|---|---|---|---|
| | 16 | 24 | 32 | 40 | 48 | total |
| Motor power (kw) in first-stage pulverizer | 18.0 | 18.0 | 18.0 | 18.0 | 18.0 | |
| Number of revolution in second-stage pulverizer (rpm) | 4500 | 4500 | 4500 | 4500 | 4500 | |
| Motor power (kw) in second-stage pulverizer | 18.0 | 18.0 | 18.0 | 18.0 | 18.0 | |
| (Particle size) | | | | | | |
| Volume-average particle diameter D50 after first-stage pulverization | 14.0 | 14.2 | 14.1 | 14.0 | 13.9 | |
| Volume-average particle diameter D50 after second-stage pulverization | 8.2 | 8.3 | 8.2 | 8.2 | 8.1 | |
| Volume-average particle diameter D50 of coarse powder in second stage | 13.9 | 13.8 | 13.7 | 13.6 | 13.8 | |
| Volume-average particle diameter D50 of classified product | 8.5 | 8.6 | 8.5 | 8.4 | 8.4 | |
| Mean circularity of first-stage pulverized product | 0.890 | 0.892 | 0.893 | 0.889 | 0.891 | |
| Mean circularity of final classified product | 0.920 | 0.919 | 0.918 | 0.921 | 0.919 | |
| Mean circularity of final classified product (standard deviation) | 0.067 | 0.064 | 0.064 | 0.063 | 0.082 | |

From Tables 3-A and 3-B, it can be seen that even when a toner having a smaller diameter than in the example 1 is produced in the line of Example 1, the pulverized product can be obtained stably and in high yield (89%) in the present invention.

The classified product was subjected to the surface-treatment by additives in the same manner as in Example 1 to give a magnetic toner (C). For the magnetic toner (C), the measurement for the charge on the magnetic toner, the examination of the developed image, the measurement for the amount of the consumed toner, and the examination of the toner dusting in the machine were conducted in the same manner as in Example 1. The results are shown in Table 9.

Comparative Example 1

In the pulverization system in Example 1, the objective volume-average particle diameter $D_{50}$ of the moderately pulverized material obtained by the first pulverizer KTM-2 in the first stage was established in the range of 19±0.5 μm, and the objective volume-average particle diameter $D_{50}$ of the pulverized material obtained by the second pulverizer KTM-2 in the second stage was established in the range of 10±0.5 μm, and accordingly the numbers of revolutions of the rotors of the first and second pulverizers were also established. Initially, the starting material was introduced in an amount of 100 kg/hr, but the amount of the classified coarse powder obtained by classifying the fine powder produced by the second pulverizer, that is, the amount of the returning powder, was as high as 80 kg/hr, and the changed amount of the returning powder fed was higher by at least 20% than the amount of the moderately pulverized product fed. After operation for 4 hours, the temperature of the pulverized material in the second stage was increased to about 70° C., and fusion of the toner powder in the second pulverizer occurred, resulting in failure to produce a toner. The standard deviation a of the circularity of the classified toner particles was 0.07 or more. The process conditions for each unit are shown in Tables 4-A and 4-B.

TABLE 4-A

| | Operation time (hr.) | | | | | |
|---|---|---|---|---|---|---|
| | 0 | 0.5 | 1 | 2 | 4 | 8 |
| Amount of starting material fed (kg/hr) (F1) | 100 | 100 | 100 | 100 | 100 | — |
| Amount of pulverized product in first stage to be fed to second pulverizer (kg/hr) (F2) | 100 | 100 | 100 | 100 | 100 | — |
| Amount of returning powder | — | 80 | 85 | 85 | 80 | — |
| Amount of returning powder fed (kg/hr) (F3) | — | 60 | 80 | 80 | 80 | — |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 4000 | 4000 | 4000 | 4000 | 4000 | — |
| Motor power (kw) in first-stage pulverizer | 15.0 | 15.0 | 15.0 | 15.0 | 15.0 | — |
| Number of revolution in second-stage pulverizer (rpm) | 6000 | 6000 | 6000 | 6000 | 6000 | — |
| Motor power (kw) in second-stage pulverizer | 19.0 | 19.5 | 19.5 | 19.5 | 19.5 | — |

TABLE 4-A-continued

| | Operation time (hr.) | | | | | |
|---|---|---|---|---|---|---|
| | 0 | 0.5 | 1 | 2 | 4 | 8 |
| (Particle size) | | | | | | |
| Volume-average particle diameter D50 after first-stage pulverization | — | 18.9 | 18.8 | 18.8 | 18.9 | — |
| Volume-average particle diameter D50 after second-stage pulverization | — | 10.1 | 10.3 | 10.5 | — | — |
| Volume-average particle diameter D50 of coarse powder in second stage | — | 17.6 | 17.8 | 17.5 | — | — |
| Volume-average particle diameter D50 of classified product | | 10.5 | 10.6 | 10.9 | — | — |
| Mean circularity of first-stage pulverized product | — | 0.885 | 0.884 | 0.886 | — | — |
| Mean circularity of final classified product | — | 0.915 | 0.916 | 0.913 | — | — |
| Mean circularity of final classified product (standard deviation) | — | 0.069 | 0.073 | 0.076 | — | — |
| Note | | | | | * | |

Note
*: After the operation for 4 hours, the temperature of the pulverized material in the second stage was increased to 70° C. to cause fusion and solidification of toner powder in the second-stage pulverizer, thus failing to produce a toner.

TABLE 4-B

| | Operation time (hr.) | | | | | |
|---|---|---|---|---|---|---|
| | 16 | 24 | 32 | 40 | 48 | total |
| Amount of starting material fed (kg/hr) (F1) | — | — | — | — | — | |
| Amount of pulverized product in first stage to be fed to second pulverizer (kg/hr) (F2) | — | — | — | — | — | |
| Amount of returning powder | — | — | — | — | — | |
| Amount of returning powder fed (kg/hr) (F3) | — | — | — | — | — | |
| Amount of final classified product (kg) | | | | | | — |
| Amount of classified fine powder (kg) | | | | | | — |
| Yield of final classified product (%) | | | | | | — |
| Amount of final classified product produced per hour (kg) | | | | | | — |
| (Process conditions) | | | | | | |
| Number of revolution in first-stage pulverizer (rpm) | — | — | — | — | — | |
| Motor power (kw) in first-stage pulverizer | — | — | — | — | — | |
| Number of revolution in second-stage pulverizer (rpm) | — | — | — | — | — | |
| Motor power (kw) in second-stage pulverizer | — | — | — | — | — | |
| (Particle size) | | | | | | |
| Volume-average particle diameter D50 after first-stage pulverization | — | — | — | — | — | |
| Volume-average particle diameter D50 after second-stage pulverization | — | — | — | — | — | |
| Volume-average particle diameter D50 of coarse powder in second stage | — | — | — | — | — | |
| Volume-average particle diameter D50 of classified product | — | — | — | — | — | |
| Mean circularity of first-stage pulverized product | — | — | — | — | — | |
| Mean circularity of final classified product | — | — | — | — | — | |
| Mean circularity of final classified product (standard deviation) | — | — | — | — | — | |
| Note | | | | ** | | |

Note
**: After the operation for 4 hours, the temperature of the pulverized material in the second stage was increased to 70° C. to cause fusion and solidification of toner powder in the second-stage pulverizer, thus failing to produce a toner.

The classified product was subjected to the surface-treatment by additives in the same manner as in Example 1 to give a magnetic toner (D). For the magnetic toner (D), the measurement for the charge on the magnetic toner, the examination of the developed image, the measurement for the amount of the consumed toner, and the examination of the toner dusting in the machine were conducted in the same manner as in Example 1. The results are shown in Table 9.

Comparative Example 2

Figure 2:
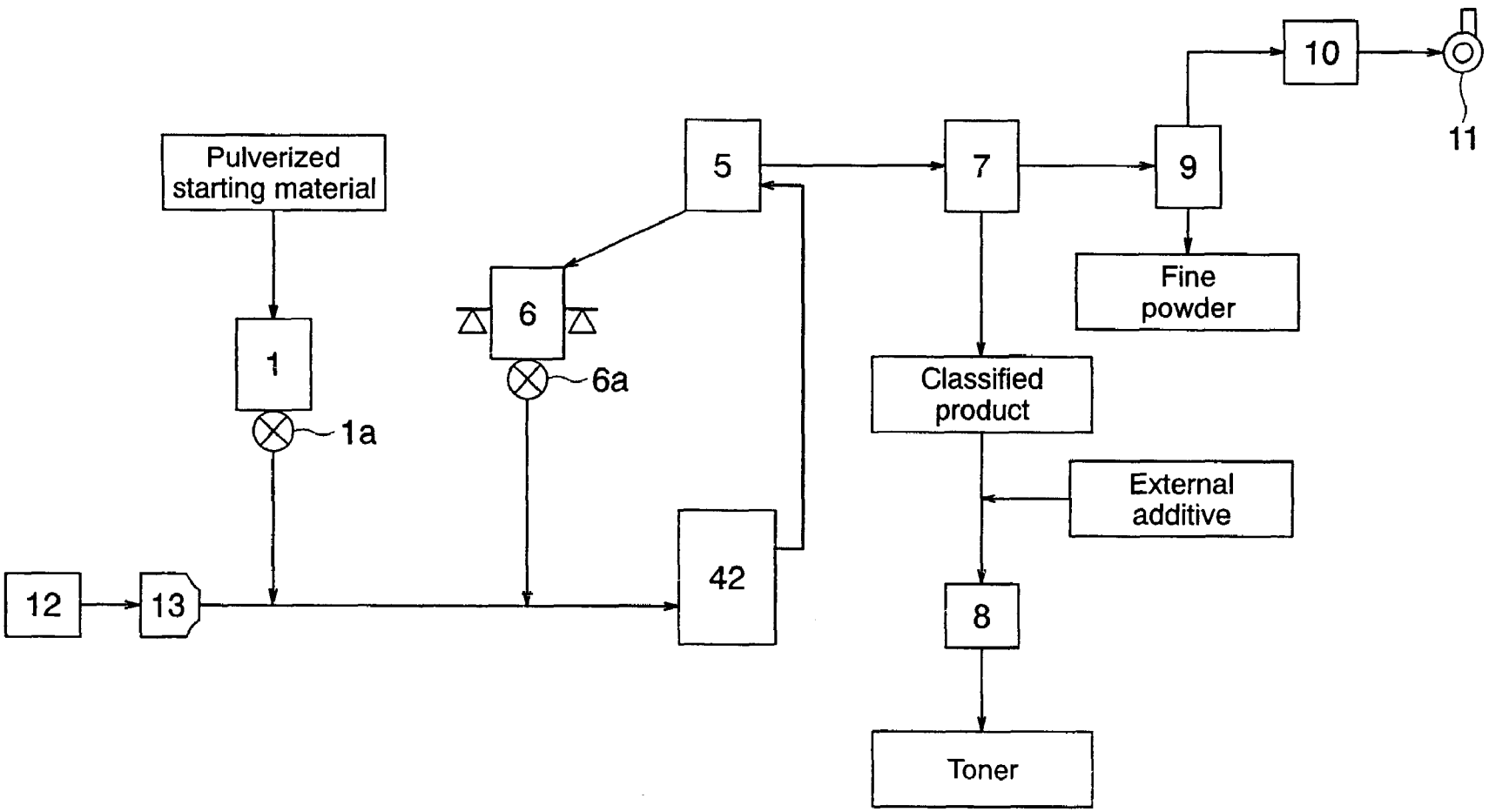
FIG. 2 is an illustrative diagram showing a method of producing an electrostatic charge image developing toner in Comparative Example wherein one mechanical pulverizer is used.

As shown in FIG. 2, the pulverizer KTM-2 was used singly in place of the two pulverizers KTM-2 connected in series in the two stages, and the finely pulverized material obtained in the pulverizer 42 was sent to the coarse-powder classifier 5 where the coarse powder was classified, and the classified coarse powder was sent to the returning-powder feeder 6 and then sent quantitatively from the returning-powder feeder 6 to the pulverizer 42, and the fine powder in the finely pulverized material from which coarse powder had been classified was classified by the fine-powder classifier 7 to give a classified product. The number of revolutions of the rotor of the pulverizer 42 was established such that the objective volume-average particle diameter $D_{50}$ of the finely pulverized material became 10.0±5 μm. First, pulverization of the starting material introduced in a rate of 50 kg/hr into the pulverizer was attempted, but the amount of the returning powder was increased so that the amount of the resulting toner particles was 37 kg/hr, and accordingly the amount of the starting material to be fed was corrected to 37 kg/hr. The fluctuation of the amount of the returning powder was also increased, and the amount of returning powder was in an amount by not less than 20% relative to the amount of the moderately pulverized material supplied, that is, the amount of the returning powder was 50% or more. By the two pulverizers connected in series, the starting material could be introduced in a rate of 100 kg/hr, but by one pulverizer, the amount of the material to be introduced was 37 kg/hr so that the productivity was as low as ⅓, and the yield was 84%. The standard deviation σ of the circularity of the classified toner particles was 0.07 or more. The process conditions for each unit are shown in Tables 5-A and 5-B.

TABLE 5-A

| | Operation time (hr.) | | | | | |
|---|---|---|---|---|---|---|
| | 0 | 0.5 | 1 | 2 | 4 | 8 |
| Amount of starting material fed (kg/hr) (F1) | 37 | 37 | 37 | 37 | 37 | 37 |
| Amount of pulverized product in first stage to be fed to second pulverizer (kg/hr) (F2) | — | — | — | — | — | — |
| Amount of returning powder | — | 25 | 30 | 25 | 30 | 30 |
| Amount of returning powder fed (kg/hr) (F3) | — | 25 | 25 | 30 | 30 | 30 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6000 | 6000 | 6000 | 6000 | 6000 | 6000 |
| Motor power (kw) in first-stage pulverizer | 22.0 | 22.0 | 22.0 | 22.0 | 22.0 | 22.0 |
| Number of revolution in second-stage pulverizer (rpm) | — | — | — | — | — | — |
| Motor power (kw) in second-stage pulverizer | — | — | — | — | — | — |
| (Particle size) | | | | | | |
| Volume-average particle diameter D50 after first-stage pulverization | — | 10.1 | 10.0 | 10.1 | 10.2 | 10.1 |
| Volume-average particle diameter D50 after second-stage pulverization | — | — | — | — | — | — |
| Volume-average particle diameter D50 of coarse powder in second stage | — | — | — | — | — | — |
| Volume-average particle diameter D50 of classified product | | 10.5 | 10.3 | 10.4 | 10.3 | 10.4 |
| Mean circularity of first-stage pulverized product | — | 0.895 | 0.897 | 0.898 | 0.897 | 0.896 |
| Mean circularity of final classified product | — | 0.896 | 0.897 | 0.899 | 0.898 | 0.898 |
| Mean circularity of final classified product (standard deviation) | — | 0.079 | 0.080 | 0.079 | 0.078 | 0.082 |

TABLE 5-B

| | Operation time (hr.) | | | | | |
|---|---|---|---|---|---|---|
| | 16 | 24 | 32 | 40 | 48 | total |
| Amount of starting material fed (kg/hr) (F1) | 37 | 37 | 37 | 37 | 37 | |
| Amount of pulverized product in first stage to be fed to second pulverizer (kg/hr) (F2) | — | — | — | — | — | |
| Amount of returning powder | 25 | 25 | 30 | 30 | 30 | |
| Amount of returning powder fed (kg/hr) (F3) | 30 | 30 | 30 | 30 | 30 | |
| Amount of final classified product (kg) | | | | | | 1490 |
| Amount of classified fine powder (kg) | | | | | | 238 |
| Yield of final classified product (%) | | | | | | 84 |
| Amount of final classified product produced per hour (kg) | | | | | | 31 |
| (Process conditions) | | | | | | |
| Number of revolution in first-stage pulverizer (rpm) | 6000 | 6000 | 6000 | 6000 | 6000 | |
| Motor power (kw) in first-stage pulverizer | 22.0 | 22.0 | 22.0 | 22.0 | 22.0 | |
| Number of revolution in second-stage pulverizer (rpm) | | | | | | |
| Motor power (kw) in second-stage pulverizer | | | | | | |
| (Particle size) | | | | | | |
| Volume-average particle diameter D50 after first-stage pulverization | 10.1 | 10.2 | 10.0 | 10.0 | 10.1 | |
| Volume-average particle diameter D50 after second-stage pulverization | — | — | — | — | — | |
| Volume-average particle diameter D50 of coarse powder in second stage | — | — | — | — | — | |
| Volume-average particle diameter D50 of classified product | 10.4 | 10.3 | 10.4 | 10.4 | 10.3 | |
| Mean circularity of first-stage pulverized product | 0.896 | 0.895 | 0.895 | 0.895 | 0.896 | |
| Mean circularity of final classified product | 0.898 | 0.896 | 0.896 | 0.895 | 0.896 | |

TABLE 5-B-continued

| | Operation time (hr.) | | | | | |
|---|---|---|---|---|---|---|
| | 16 | 24 | 32 | 40 | 48 | total |
| Mean circularity of final classified product (standard deviation) | 0.074 | 0.084 | 0.078 | 0.078 | 0.077 | |

The classified product was subjected to the surface-treatment by additives in the same manner as in Example 1 to give a magnetic toner (E). For the magnetic toner (E), the measurement for the charge on the magnetic toner, the examination of the developed image, the measurement for the amount of the consumed toner, and the examination of the toner dusting in the machine were conducted in the same manner as in Example 1. The results are shown in Table 9.

Comparative Example 3

Toner powder was produced by using the same pulverization system and units as in Example 1 except that Hosokawa Vatic Mill MVM-60 manufactured by Hosokawa Micron Corporation was used in place of the first pulverizer KTM-2, and a collision pulverizer (Jet Mill I-20) was used in place of the second pulverizer KTM-2. The objective volume-average particle diameter $D_{50}$ of the moderately pulverized material was established in the range of 30±0.5 μm, and the objective volume-average particle diameter $D_{50}$ in the collision pulverizer in the second stage was established in the range of 10±0.5 μm, and accordingly the operation conditions of the first and second pulverizers were established. The process conditions for each unit are shown in Tables 6-A and 6-B.

TABLE 6-A

| | Operation time (hr.) | | | | | |
|---|---|---|---|---|---|---|
| | 0 | 0.5 | 1 | 2 | 4 | 8 |
| Amount of starting material fed (kg/hr) (F1) | 100 | 80 | 80 | 80 | 80 | 80 |
| Amount of pulverized product in first stage to be fed to second pulverizer (kg/hr) (F2) | 98 | 79 | 79 | 79 | 79 | 79 |
| Amount of returning powder | — | 50 | 52 | 54 | 56 | 54 |
| Amount of returning powder fed (kg/hr) (F3) | — | 50 | 55 | 55 | 55 | 55 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 2600 | 2600 | 2600 | 2600 | 2600 | 2600 |
| Motor power (kw) in first-stage pulverizer | 30.0 | 30.0 | 30.0 | 30.0 | 30.0 | 30.0 |
| Number of revolution in second-stage pulverizer (rpm) | — | — | — | — | — | — |
| Motor power (kw) in second-stage pulverizer | | | | | | |
| (Particle size) | | | | | | |
| Volume-average particle diameter D50 after first-stage pulverization | — | 30.3 | 30.4 | 30.3 | 30.5 | 30.3 |
| Volume-average particle diameter D50 after second-stage pulverization | — | 11.3 | 11.2 | 11.3 | 11.3 | 11.2 |
| Volume-average particle diameter D50 of coarse powder in second stage | — | — | 17.8 | — | — | — |
| Volume-average particle diameter D50 of classified product | | 10.8 | 10.7 | 10.8 | 10.8 | 10.7 |
| Mean circularity of first-stage pulverized product | — | 0.863 | 0.864 | — | — | — |
| Mean circularity of final classified product | — | 0.881 | 0.882 | 0.879 | 0.878 | 0.880 |
| Mean circularity of final classified product (standard deviation) | — | 0.081 | 0.082 | 0.082 | 0.084 | 0.080 |

TABLE 6-B

| | Operation time (hr.) | | | | | |
|---|---|---|---|---|---|---|
| | 16 | 24 | 32 | 40 | 48 | total |
| Amount of starting material fed (kg/hr) (F1) | 80 | 80 | 80 | 80 | 80 | |
| Amount of pulverized product in first stage to be fed to second pulverizer (kg/hr) (F2) | 79 | 79 | 79 | 79 | 79 | |

TABLE 6-B-continued

| | Operation time (hr.) | | | | | |
|---|---|---|---|---|---|---|
| | 16 | 24 | 32 | 40 | 48 | total |
| Amount of returning powder | 53 | 55 | 55 | 50 | 53 | |
| Amount of returning powder fed (kg/hr) (F3) | 55 | 50 | 50 | 55 | 55 | |
| Amount of final classified product (kg) | | | | | | 3840 |
| Amount of classified fine powder (kg) | | | | | | 900 |
| Yield of final classified product (%) | | | | | | 81 |
| Amount of final classified product produced per hour (kg) | | | | | | 80 |
| (Process conditions) | | | | | | |
| Number of revolution in first-stage pulverizer (rpm) | 2600 | 2600 | 2600 | 2600 | 2600 | |
| Motor power (kw) in first-stage pulverizer | 30.0 | 30.0 | 30.0 | 30.0 | 30.0 | |
| Number of revolution in second-stage pulverizer (rpm) | | | | | | |
| Motor power (kw) in second-stage pulverizer | | | | | | |
| (Particle size) | | | | | | |
| Volume-average particle diameter D50 after first-stage pulverization | 30.2 | 30.3 | 30.4 | 30.3 | 30.2 | |
| Volume-average particle diameter D50 after second-stage pulverization | 11.3 | 11.4 | 11.2 | 11.2 | 11.3 | |
| Volume-average particle diameter D50 of coarse powder in second stage | — | 17.6 | — | — | 17.5 | |
| Volume-average particle diameter D50 of classified product | 10.8 | 10.8 | 10.7 | 10.7 | 10.7 | |
| Mean circularity of first-stage pulverized product | — | 0.867 | 0.867 | 0.865 | 0.866 | |
| Mean circularity of final classified product | 0.881 | 0.882 | 0.880 | 0.879 | 0.881 | |
| Mean circularity of final classified product (standard deviation) | 0.079 | 0.084 | 0.082 | 0.083 | 0.080 | |

As can be seen from Tables 6-A and 6-B, the yield of the classified product was 81%. The standard deviation σ of the circularity of toner particles in the resulting classified product was 0.07 or more, and the shape was varied and angular. The classified product was subjected to the surface-treatment by additives in the same manner as in Example 1 to give a magnetic toner (F). For the magnetic toner (F), the measurement for the charge on the magnetic toner, the examination of the developed image, the measurement for the amount of the consumed toner, and the examination of the toner dusting in the machine were conducted in the same manner as in Example 1. The results are shown in Table 9. The product was inferior in fluidity and poor in image density.

Comparative Example 4

A classified product was produced by use of the same pulverization system and units as in Example 1 except that the whole of the coarse powder classified by the coarse-powder classifier 5 was fed from the returning-powder feeder 6 to the second pulverizer 4. The process conditions are shown in Tables 7-A and 7-B.

TABLE 7-A

| | Operation time (hr.) | | | | | |
|---|---|---|---|---|---|---|
| | 0 | 0.5 | 1 | 2 | 4 | 8 |
| Amount of starting material fed (kg/hr) (F1) | 100 | 100 | 100 | 100 | 100 | 100 |
| Amount of pulverized product in first stage to be fed to second pulverizer (kg/hr) (F2) | 100 | 100 | 100 | 100 | 100 | 100 |
| Amount of returning powder | — | 50 | 40 | 42 | 35 | 45 |
| Amount of returning powder fed (kg/hr) (F3) | — | 50 | 40 | 42 | 35 | 45 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6000 | 6000 | 6000 | 6000 | 6000 | 6000 |
| Motor power (kw) in first-stage pulverizer | 20.5 | 20.5 | 20.5 | 20.5 | 20.5 | 20.5 |
| Number of revolution in second-stage pulverizer (rpm) | 4000 | 4000 | 4000 | 4000 | 4000 | 4000 |
| Motor power (kw) in second-stage pulverizer | 15.5 | 15.5 | 15.5 | 15.5 | 15.5 | 15.5 |

TABLE 7-A-continued

| | Operation time (hr.) | | | | | |
|---|---|---|---|---|---|---|
| | 0 | 0.5 | 1 | 2 | 4 | 8 |
| (Particle size) | | | | | | |
| Volume-average particle diameter D50 after first-stage pulverization | — | 15.2 | 14.1 | 14.3 | 13.8 | 14.0 |
| Volume-average particle diameter D50 after second-stage pulverization | — | 10.3 | 10.3 | 10.5 | 9.5 | 10.4 |
| Volume-average particle diameter D50 of coarse powder in second stage | — | 15.6 | 16.1 | 16.3 | 16.3 | 16.6 |
| Volume-average particle diameter D50 of classified product | | 11.8 | 10.7 | 11.2 | 10.2 | 11.1 |
| Mean circularity of first-stage pulverized product | — | 0.892 | 0.889 | 0.890 | 0.891 | 0.892 |
| Mean circularity of final classified product | — | 0.904 | 0.913 | 0.914 | 0.914 | 0.913 |
| Mean circularity of final classified product (standard deviation) | — | 0.084 | 0.068 | 0.079 | 0.075 | 0.081 |

TABLE 7-B

| | Operation time (hr.) | | | | | |
|---|---|---|---|---|---|---|
| | 16 | 24 | 32 | 40 | 48 | total |
| Amount of starting material fed (kg/hr) (F1) | 100 | 100 | 100 | 100 | 100 | |
| Amount of pulverized product in first stage to be fed to second pulverizer (kg/hr) (F2) | 100 | 100 | 100 | 100 | 100 | |
| Amount of returning powder | 40 | 38 | 43 | 40 | 34 | |
| Amount of returning powder fed (kg/hr) (F3) | 40 | 38 | 43 | 40 | 34 | |
| Amount of final classified product (kg) | | | | | | 4080 |
| Amount of classified fine powder (kg) | | | | | | 720 |
| Yield of final classified product (%) | | | | | | 85 |
| Amount of final classified product produced per hour (kg) | | | | | | 85 |
| (Process conditions) | | | | | | |
| Number of revolution in first-stage pulverizer (rpm) | 6000 | 6000 | 6000 | 6000 | 6000 | |
| Motor power (kw) in first-stage pulverizer | 20.5 | 20.5 | 20.5 | 20.5 | 20.5 | |
| Number of revolution in second-stage pulverizer (rpm) | 4000 | 4000 | 4000 | 4000 | 4000 | |
| Motor power (kw) in second-stage pulverizer | 15.5 | 15.5 | 15.5 | 15.5 | 15.5 | |
| (Particle size) | | | | | | |
| Volume-average particle diameter D50 after first-stage pulverization | 14.2 | 14.2 | 14.1 | 14.1 | 13.8 | |
| Volume-average particle diameter D50 after second-stage pulverization | 10.1 | 9.7 | 9.9 | 10.2 | 9.1 | |
| Volume-average particle diameter D50 of coarse powder in second stage | 16.6 | 16.7 | 16.4 | 16.8 | 16.7 | |
| Volume-average particle diameter D50 of classified product | 10.4 | 10.0 | 10.2 | 10.6 | 9.4 | |
| Mean circularity of first-stage pulverized product | 0.890 | 0.888 | 0.891 | 0.891 | 0.892 | |
| Mean circularity of final classified product | 0.912 | 0.912 | 0.913 | 0.913 | 0.913 | |
| Mean circularity of final classified product (standard deviation) | 0.072 | 0.070 | 0.078 | 0.073 | 0.076 | |

From Tables 7-A and 7-B, it can be seen that when the production was conducted by use of the unit not having performance in feeding the returning material in the predetermined range to the KTM-2 in the second stage, the particle-size distribution was varied and not stable due to a varying amount of the material introduced into the pulverizer 4 in the second stage. The operation was conducted for 48 hours, but fluctuation was significant. The particle size was not stable particularly at the start of production. Accordingly, stable production of the product was difficult. The yield was 85%.

The classified product was subjected to the surface-treatment by additives in the same manner as in Example 1 to give a magnetic toner (G). For the magnetic toner (G), the measurement for the charge on the magnetic toner, the examination of the developed image, the measurement for the amount of the consumed toner, and the examination of the toner dusting in the machine were conducted in the same manner as in Example 1. The results are shown in Table 9.

Reference Example 1

Figure 3:
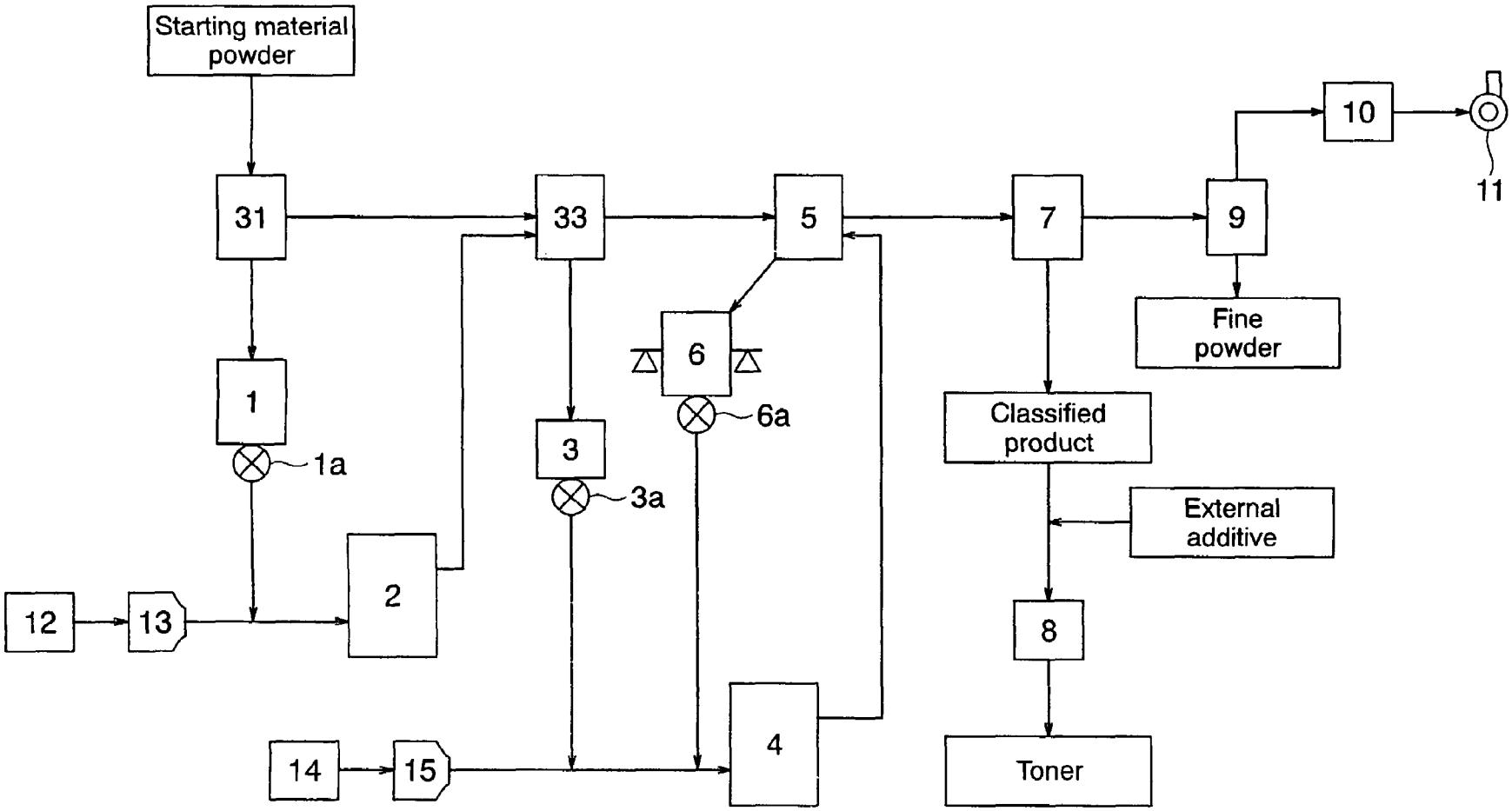
FIG. 3 is an illustrative diagram showing a method of producing an electrostatic charge image developing toner in Reference Example 1 wherein classifiers for classifying fine powder in a pulverized starting material and in a moderately pulverized material are arranged.
Figure 4:
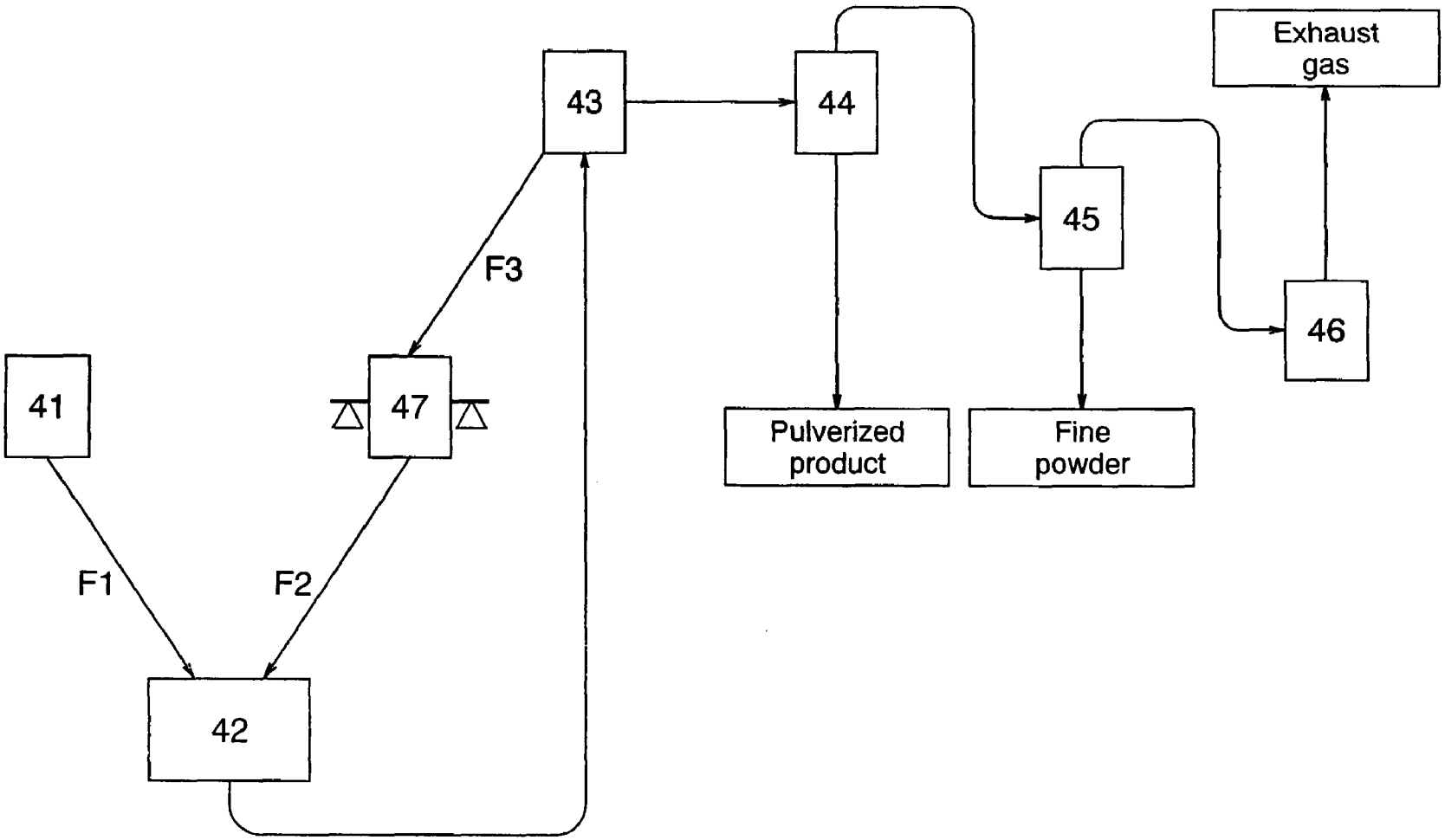
FIG. 4 is an illustrative diagram showing a method of producing an electrostatic charge image developing toner in a conventional closed circuit system.

As shown in FIG. 3, a classified product was obtained by the same pulverization system and units as in Example 1 except that the fine powder (particle diameter of 20 μm or less) in the pulverized starting material was classified and removed in the fine-powder classifier 31, and the removed fine powder, together with the moderately pulverized material pulverized by the first pulverizer 2, was fed again to the fine powder classifier 33, and the fine powder (particle diameter of 12 μm or less) in the moderately pulverized material and in the classified fine powder was removed by classification with the fine-powder classifier 33, and the pulverized material from which fine powder had been removed was fed to the second pulverizer 4, and the fine powder classified by the classifier 33, together with the finely pulverized material pulverized by the second pulverizer 4, was fed to the coarse-powder classifier 5. The process conditions are shown in Tables 8-A and 8-B.

TABLE 8-A

| | Operation time (hr.) | | | | | |
|---|---|---|---|---|---|---|
| | 0 | 0.5 | 1 | 2 | 4 | 8 |
| Amount of starting material fed (kg/hr) (F1) | 100 | 100 | 100 | 100 | 100 | 100 |
| Amount of pulverized product in first stage to be fed to second pulverizer (kg/hr) (F2) | 100 | 100 | 100 | 100 | 100 | 100 |
| Amount of returning powder | — | 20 | 30 | 30 | 27 | 20 |
| Amount of returning powder fed (kg/hr) (F3) | — | 20 | 20 | 27 | 27 | 27 |
| Amount of final classified product (kg) | | | | | | |
| Amount of classified fine powder (kg) | | | | | | |
| Yield of final classified product (%) | | | | | | |
| Amount of final classified product produced per hour (kg) | | | | | | |
| (Process conditions) | | | | | | |
| Number of revolution in first-stage pulverizer (rpm) | 6000 | 6000 | 6000 | 6000 | 6000 | 6000 |
| Motor power (kw) in first-stage pulverizer | 18.0 | 18.0 | 18.0 | 17.5 | 18.0 | 18.0 |
| Number of revolution in second-stage pulverizer (rpm) | 4000 | 4000 | 4000 | 4000 | 4000 | 4000 |
| Motor power (kw) in second-stage pulverizer | 15.5 | 15.5 | 15.5 | 15.5 | 15.5 | 15.5 |
| (Particle size) | | | | | | |
| Volume-average particle diameter D50 after first-stage pulverization | — | 14.0 | 13.8 | 14.1 | 14.2 | 14.0 |
| Volume-average particle diameter D50 after second-stage pulverization | — | 9.8 | 10.0 | 9.8 | 9.8 | 9.9 |
| Volume-average particle diameter D50 of coarse powder in second stage | — | 15.6 | 15.8 | 15.4 | 15.6 | 15.5 |
| Volume-average particle diameter D50 of classified product | | 10.3 | 10.5 | 10.4 | 10.2 | 10.5 |
| Mean circularity of first-stage pulverized product | — | 0.885 | 0.885 | 0.884 | 0.886 | 0.884 |
| Mean circularity of final classified product | — | 0.905 | 0.904 | 0.903 | 0.904 | 0.904 |
| Mean circularity of final classified product (standard deviation) | — | 0.092 | 0.093 | 0.092 | 0.093 | 0.091 |

TABLE 8-B

| | Operation time (hr.) | | | | | |
|---|---|---|---|---|---|---|
| | 16 | 24 | 32 | 40 | 48 | total |
| Amount of starting material fed (kg/hr) (F1) | 100 | 100 | 100 | 100 | 100 | |
| Amount of pulverized product in first stage to be fed to second pulverizer (kg/hr) (F2) | 100 | 100 | 100 | 100 | 100 | |
| Amount of returning powder | 20 | 20 | 20 | 20 | 20 | |
| Amount of returning powder fed (kg/hr) (F3) | 27 | 27 | 20 | 20 | 20 | |
| Amount of final classified product (kg) | | | | | | 4224 |
| Amount of classified fine powder (kg) | | | | | | 576 |
| Yield of final classified product (%) | | | | | | 88 |
| Amount of final classified product produced per hour (kg) | | | | | | 88 |
| (Process conditions) | | | | | | |
| Number of revolution in first-stage pulverizer (rpm) | 6000 | 6000 | 6000 | 6000 | 6000 | |
| Motor power (kw) in first-stage pulverizer | 17.5 | 18.0 | 18.0 | 18.0 | 18.0 | |
| Number of revolution in second-stage pulverizer (rpm) | 4000 | 4000 | 4000 | 4000 | 4000 | |
| Motor power (kw) in second-stage pulverizer | 15.5 | 15.5 | 15.5 | 15.5 | 15.5 | |
| (Particle size) | | | | | | |
| Volume-average particle diameter D50 after first-stage pulverization | 14.3 | 14.1 | 13.9 | 14.2 | 14.1 | |

TABLE 8-B-continued

| | Operation time (hr.) | | | | | |
|---|---|---|---|---|---|---|
| | 16 | 24 | 32 | 40 | 48 | total |
| Volume-average particle diameter D50 after second-stage pulverization | 10.0 | 9.8 | 10.1 | 9.9 | 9.9 | |
| Volume-average particle diameter D50 of coarse powder in second stage | 15.5 | 15.3 | 15.4 | 15.2 | 15.4 | |
| Volume-average particle diameter D50 of classified product | 10.6 | 10.2 | 10.5 | 10.5 | 10.5 | |
| Mean circularity of first-stage pulverized product | 0.885 | 0.884 | 0.885 | 0.886 | 0.884 | |
| Mean circularity of final classified product | 0.905 | 0.904 | 0.906 | 0.905 | 0.904 | |
| Mean circularity of final classified product (standard deviation) | 0.095 | 0.096 | 0.095 | 0.094 | 0.093 | |

As can be seen from Tables 8-A and 8-B, the product was excellent in productivity and stability, but the toner shape of the classified product was not stable, and the standard deviation of the circularity was 0.09. By the method of this Reference Example, automatic production without regulation was feasible, but the qualities of the product were varied. The yield was 88%.

The classified product was subjected to the surface-treatment by additives in the same manner as in Example 1 to give a magnetic toner (H). For the magnetic toner (H), the measurement for the charge on the magnetic toner, the examination of the developed image, the measurement for the amount of the consumed toner, and the examination of the toner dusting in the machine were conducted in the same manner as in Example 1. The results are shown in Table 9.

TABLE 9

| | Sample | Charge (+μc/g) | Image density Initital | Image density 10,000th copied | Fog density Initital | Fog density 10,000th copied | Toner consumption (g/K) | Dusting level in the machine |
|---|---|---|---|---|---|---|---|---|
| Example 1 | Magnetic toner (A) | 15.3 | 1.41 | 1.42 | 0.6 | 0.5 | 75 | None |
| Example 2 | Magnetic toner (B) | 15.1 | 1.42 | 1.42 | 0.7 | 0.7 | 76 | None |
| Example 3 | Magnetic toner (C) | 16.6 | 1.42 | 1.43 | 0.5 | 0.6 | 77 | None |
| Comparative Example 1 | Magnetic toner (D)*1 | 14.6 | 1.38 | 1.28 | 0.6 | 0.8 | 70 | None |
| Comparative Example 2 | Magnetic toner (E) | 14.3 | 1.37 | 1.27 | 0.7 | 0.6 | 72 | None |
| Comparative Example 3 | Magnetic toner (F) | 12.9 | 1.29 | 1.24 | 0.8 | 0.9 | 68 | Slightly detected |
| Comparative Example 4 | Magnetic toner (G) | 15.1 | 1.39 | 1.38 | 0.9 | 0.7 | 77 | None |
| Reference Example 1 | Magnetic toner (H) | 14.7 | 1.34 | 1.31 | 1.1 | 1.4 | 76 | None |

Table Note:
As the toner sample, a toner obtained after the operation for 48 hours was used.
*1A toner obtained until the operation for 4 hours was used in evaluation.

From the results in Table 9, any magnetic toners obtained in the Examples were highly charged, and had the image density which was high from the start of the test and stable for a long time, showed low fog density even after copying of 10,000 sheets, and observed no dusting of the toner in the machine.

In Comparative Example 1 wherein the volume-average particle diameter of the moderately pulverized material was not in the range greater by 3 to 6 μm than the volume-average particle diameter of the finely pulverized material, the continuous operation for 48 hours could not be feasible, and the charge and image density of the resulting magnetic toner (D) were slightly lower than those of the magnetic toner in the Examples. In addition, after copying of 10,000 sheets, the image density was reduced and fog density was increased. The magnetic toner (E) obtained by using one pulverizer in Comparative Example 2 had a problem not only in productivity of toner powder but also in slightly lower charge and image density and a reduction of image density after copied 10,000 sheets. The magnetic toner (F) obtained in Comparative Example 3 wherein the difference in volume-average particle diameter between the moderately pulverized material and the finely pulverized material was not within 3 to 6 μm and the mechanical pulverizer was not used as the second pulverizer, was poor in properties such as charging, image density and fog density, and had a problem in toner dusting in the machine. The magnetic toner in Reference Example 1, which was produced in a system of classifying fine particles in the pulverized starting material and in the moderately pulverized material, had a problem of fog density possibly due to varying circularity.

According to the method of producing an electrostatic charge image developing toner according to the present invention, a toner having a desired particle diameter can be obtained stably for a long time from the start of production, the units can be operated stably for a long time, and automatic production of toner is feasible. Further, the produced toner is excellent in development properties.

Therefore, the toner obtained by the production method of the present invention can be used preferably as a dry developer in the electrophotographic system in copiers, printers etc.

In addition by using the production method of the present invention, a toner of stable and high qualities can be produced without adjustment or regulation of the production units for a long time.

What is claimed is:

1. A method of producing an electrostatic charge image developing toner, which comprises at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D1 (μm) of the moderately pulverized material obtained by the first mechanical pulverizer and the volume-average particle diameter D2 (μm) of the finely pulverized material obtained by the second mechanical pulverizer satisfy the equation: $3\ \mu m \leqq D1-D2 \leqq 6\ \mu m$.

2. A method of producing an electrostatic charge image developing toner, which comprises at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D2 (μm) of the finely pulverized material obtained by the second mechanical pulverizer and the volume-average particle diameter D3 (μm) of the coarse powder classified in the coarse-powder classifier satisfy the equation: $D3-D2 \leqq 6\ \mu m$.

3. A method of producing an electrostatic charge image developing toner, which comprises at least a binder resin and a colorant, by pulverization in a closed circuit, wherein a pulverized starting material is supplied quantitatively to a first mechanical pulverizer and then pulverized moderately therein, the resulting moderately pulverized material is supplied to a second mechanical pulverizer and pulverized finely therein, and the resulting finely pulverized material is introduced into a coarse-powder classifier to classify coarse powder not smaller than a predetermined particle diameter, the finely pulverized material from which coarse powder was removed by classification is further classified to remove fine powder not larger than a predetermined particle size and a classified product is obtained, while the separated classified coarse powder is introduced into a returning-powder feeder, the classified coarse powder introduced into the returning-powder feeder is quantitatively supplied again to the second mechanical pulverizer, upon which when it is detected that the weight of the coarse powder stored in the returning-powder feeder is deviated from a predetermined range, the amount of the returning coarse powder supplied to the second mechanical pulverizer is changed and regulated such that the quantitative supply of the coarse powder is conducted in such a changed amount, and the volume-average particle diameter D1 (μm) of the moderately pulverized material obtained by the first mechanical pulverizer, the volume-average particle diameter D2 (μm) of the finely pulverized material obtained by the second mechanical pulverizer and the volume-average particle diameter D3 (μm) of the coarse powder classified in the coarse-powder classifier satisfy the following equations: $3\ \mu m \leqq D1-D2 \leqq 6\ \mu m$, and $D3-D2 \leqq 6\ \mu m$.

4. The method of producing an electrostatic charge image developing toner according to any one of claims 1 to 3, wherein the changed amount of the returning powder supplied from the returning-powder feeder to the second mechanical pulverizer is within ±20% relative to the amount of the moderately pulverized material supplied to the second mechanical pulverizer.

5. The method of producing an electrostatic charge image developing toner according to any one of claims 1 to 3, wherein the circularity of the moderately pulverized material is 0.88 to 0.90, the circularity of the classified product is 0.90 to 0.93, and the standard deviation of the circularity of the classified product is 0.07 or less.

6. The method of producing an electrostatic charge image developing toner according to any one of claims 1 to 3, wherein the moderately pulverized material obtained by pulverization in the first mechanical pulverizer is sent to a moderate pulverized material quantitative feeder and supplied quantitatively from the moderately pulverized material quantitative feeder to the second mechanical pulverizer, in the same amount as that of the pulverized starting material to be supplied.

7. The method of producing an electrostatic charge image developing toner according to any one of claims 1 to 3, wherein the whole of the moderately pulverized material obtained by the first mechanical pulverizer is supplied to the second mechanical pulverizer.

8. The method of producing an electrostatic charge image developing toner according to any one of claims 1 to 3, wherein the pulverized starting material and/or the moderately pulverized material is supplied without classification to the first or second mechanical pulverizer.

9. The method of producing an electrostatic charge image developing toner according to any one of claims 1 to 3, wherein the volume-average particle diameter of the classified product is 5 to 12 μm.

10. The method of producing an electrostatic charge image developing toner according to any one of claims 1 to 3, wherein the amount of the classified coarse powder obtained by the coarse-powder classification is less than 50% of the amount of the fine pulverized material obtained by the second pulverizer.

11. The method of producing an electrostatic charge image developing toner according to any one of claims 1 to 3, wherein the coarse-powder classifier is an air stream classifier.

12. The method of producing an electrostatic charge image developing toner according to any one of claims 1 to 3, wherein the classified product is mixed with an external additive.

* * * * *

UNITED STATES PATENT AND TRADEMARK OFFICE

CERTIFICATE OF CORRECTION

PATENT NO. : 7,323,283 B2
APPLICATION NO. : 11/068832
DATED : January 29, 2008
INVENTOR(S) : Nobuyuki Yoshimoto et al.

It is certified that error appears in the above-identified patent and that said Letters Patent is hereby corrected as shown below:

On the title page item "(73) Assignee: Toyo Ink Mgf. Co., Ltd., Tokyo (JP)" to --(73) Assignee: Toyo Ink Mfg. Co., Ltd., Tokyo (JP)--.

In Column 11, line 45, change "powder classifier 5 is 3 (μm), the difference (D3-D2)" to --powder classifier 5 is D3 (μm), the difference (D3-D2)--.

Signed and Sealed this

Twenty-sixth Day of August, 2008

JON W. DUDAS
*Director of the United States Patent and Trademark Office*